US009067449B2

(12) United States Patent
Morita et al.

(10) Patent No.: US 9,067,449 B2
(45) Date of Patent: Jun. 30, 2015

(54) IMAGE RECORDING METHOD BY SERIALLY TRANSFERRING INTERMEDIATE IMAGES

(71) Applicant: CANON KABUSHIKI KAISHA, Tokyo (JP)

(72) Inventors: Akira Morita, Kawasaki (JP); Sayaka Nomura, Minoh (JP); Noboru Toyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/296,930

(22) Filed: Jun. 5, 2014

(65) Prior Publication Data

US 2014/0368592 A1 Dec. 18, 2014

(30) Foreign Application Priority Data

Jun. 13, 2013 (JP) ..... 2013-124577

(51) Int. Cl.
*B41J 2/01* (2006.01)
*B41M 5/035* (2006.01)
*B41J 2/005* (2006.01)

(52) U.S. Cl.
CPC ..... *B41M 5/035* (2013.01); *B41J 2/0057* (2013.01)

(58) Field of Classification Search
USPC ..... 347/103, 101, 102, 213, 187
See application file for complete search history.

(56) References Cited

U.S. PATENT DOCUMENTS 5,008,690 A * 4/1991 Koizumi et al. ..... 346/140.1
6,386,696 B1 * 5/2002 Rodi et al. ..... 347/103

FOREIGN PATENT DOCUMENTS

JP H05-318714 A 12/1993

* cited by examiner

*Primary Examiner* — Henok Legesse
(74) *Attorney, Agent, or Firm* — Fitzpatrick, Cella, Harper & Scinto

(57) ABSTRACT

Provided is an image recording method, including an intermediate image formation step of forming an intermediate image by applying ink onto a first intermediate transfer member; a first transfer step of transferring, onto a second intermediate transfer member, the intermediate image that is formed on the first intermediate transfer member; and a second transfer step of transferring, onto a recording medium, the intermediate image that is transferred onto the second intermediate transfer member, in which the following relationship is satisfied: Fa<Fb<Fc, where Fa represents an adhesion force between the first intermediate transfer member and the intermediate image, Fb represents an adhesion force between the second intermediate transfer member and the intermediate image, and Fc represents an adhesion force between the recording medium and the intermediate image.

7 Claims, 4 Drawing Sheets

IMAGE RECORDING METHOD BY SERIALLY TRANSFERRING INTERMEDIATE IMAGES

BACKGROUND OF THE INVENTION

1. Field of the Invention

The present invention relates to an image recording method.

2. Description of the Related Art

There is known a method of applying ink onto an intermediate transfer member to record an intermediate image thereon, and transferring the intermediate image onto a recording medium to record the image thereon (hereinafter referred to also as "intermediate transfer type image recording method"). In recent years, with an increasing demand for high-speed recording, studies have been conducted to attain an intermediate transfer type image recording method for obtaining a high-quality image even at high transfer speed.

As the intermediate transfer type image recording method, there is known an intermediate transfer type image recording method employing a two-step transfer system, which is configured to use two intermediate transfer members, form an intermediate image on one of the intermediate transfer members, temporarily transfer the intermediate image onto the other of the intermediate transfer members, and then transfer the intermediate image onto a recording medium. With this system, the intermediate transfer members can be downsized, and the entire apparatus can be downsized.

Japanese Patent Application Laid-Open No. H05-318714 discloses an intermediate transfer type image recording method employing a two-step transfer system, which is configured to utilize electrostatic transfer for transferring an intermediate image from a first intermediate transfer member onto a second intermediate transfer member, to thereby transfer the intermediate image from the second intermediate transfer member onto a recording medium at low pressure.

In the method disclosed in Japanese Patent Application Laid-Open No. H05-318714, however, ink needs to be charged negatively, and hence there is a restriction on a material to be used for ink. In other words, there may be a situation where the transfer rate for various kinds of ink cannot be enhanced when the intermediate image formed on the intermediate transfer member is to be transferred onto the recording medium.

SUMMARY OF THE INVENTION

The present invention has been made in view of the problem described above. Specifically, the present invention has an object to provide an intermediate transfer type image recording apparatus employing a two-step transfer system, which is capable of obtaining an image at high transfer rate irrespective of the kind of a material to be used for ink.

The above-mentioned object is attained by the present invention described below. Specifically, according to an embodiment of the present invention, there is provided an image recording method, including an intermediate image formation step of forming an intermediate image by applying ink onto a first intermediate transfer member; a first transfer step of transferring, onto a second intermediate transfer member, the intermediate image that is formed on the first intermediate transfer member; and a second transfer step of transferring, onto a recording medium, the intermediate image that is transferred onto the second intermediate transfer member, in which the following relationship is satisfied: $Fa<Fb<Fc$, where Fa represents an adhesion force between the first intermediate transfer member and the intermediate image, Fb represents an adhesion force between the second intermediate transfer member and the intermediate image, and Fc represents an adhesion force between the recording medium and the intermediate image.

According to an embodiment of the present invention, the image recording method having high transfer rate can be provided.

Further features of the present invention will become apparent from the following description of exemplary embodiments with reference to the attached drawings.

DESCRIPTION OF THE EMBODIMENTS

Figure 1:
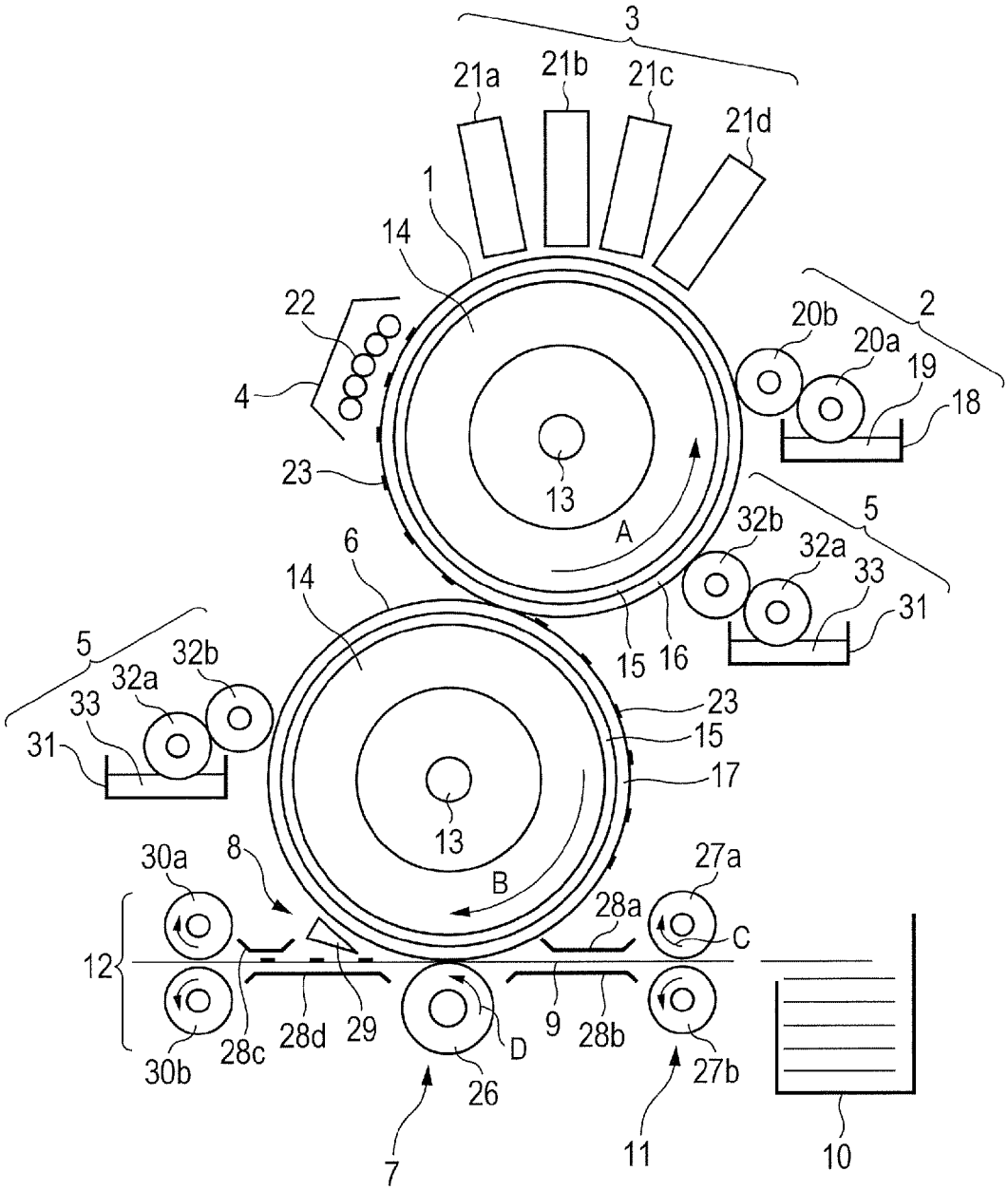
FIG. 1 is a schematic view illustrating an example of an image recording apparatus to be used for an image recording method according to a first embodiment of the present invention.

Preferred embodiments of the present invention will now be described in detail in accordance with the accompanying drawings.

Now, exemplary embodiments of the present invention are described in detail.

An image recording method of the present invention includes: an intermediate image formation step of forming an intermediate image by applying ink onto a first intermediate transfer member; a first transfer step of transferring, onto a second intermediate transfer member, the intermediate image that is formed on the first intermediate transfer member; and a second transfer step of transferring, onto a recording medium, the intermediate image that is transferred onto the second intermediate transfer member. An image recording apparatus at least includes an ink ejection portion configured to eject ink, a first intermediate transfer member, and a second intermediate transfer member.

Further, the adhesion force Fa between the first intermediate transfer member and the intermediate image, the adhesion force Fb between the second intermediate transfer member and the intermediate image, and the adhesion force Fc between the recording medium and the intermediate image are set so as to satisfy the relationship of $Fa<Fb<Fc$. In other words, the magnitude of the adhesion force with respect to the intermediate image becomes larger in the order of the first intermediate transfer member, the second intermediate transfer member, and the recording medium. In examples of the present invention, the adhesion force of the intermediate image is measured by the following method using a probe tack tester.

First, a first intermediate transfer member, a second intermediate transfer member, and a recording medium, which are cut out into a circular shape with a diameter of 5 mm, are prepared as measurement samples, respectively, and a test image is formed on those measurement samples. Then, using a probe tack tester (product name: Tackiness Tester TK1, manufactured by Malcom Co.), the probe having a diameter of 5 mm is pressed against the test image under the conditions of a pressurization force of 20 kg/cm$^2$, a pressurization time of 0.1 second, and a drawing speed of mm/sec, and the test image is transferred from the intermediate transfer member or the recording medium onto the probe. At this time, the force applied when the test image is released from the measurement sample is measured, and hence the adhesion force between each measurement sample and the intermediate image is measured.

The inventors of the present invention have presumed the following as the reason why the transfer rate is enhanced with the configuration of the present invention. In order to transfer the intermediate image from the first intermediate transfer member onto the second intermediate transfer member, the intermediate image needs to be released from the first intermediate transfer member due to at least the adhesion force between the second intermediate transfer member and the intermediate image. Thus, when the adhesion force between the intermediate image and the first intermediate transfer member is larger than the adhesion force between the intermediate image and the second intermediate transfer member, it is difficult to transfer the intermediate image onto the second intermediate transfer member, resulting in transfer residuals on the first intermediate transfer member. Conversely, when the adhesion force between the intermediate image and the second intermediate transfer member is larger than the adhesion force between the intermediate image and the first intermediate transfer member, the intermediate image is released from the first intermediate transfer member, and is transferred onto the second intermediate transfer member. Similarly, when the adhesion force between the intermediate image and the recording medium is larger than the adhesion force between the intermediate image and the second intermediate transfer member, the intermediate image is released from the second intermediate transfer member, and is transferred onto the recording medium.

In the present invention, it is further preferred that the adhesion force Fa between the first intermediate transfer member and the intermediate image, the adhesion force Fb between the second intermediate transfer member and the intermediate image, and the adhesion force Fc between the recording medium and the intermediate image be set so as to satisfy the relationship of $9Fa/4<3Fb/2<Fc$.

Further, it is preferred that the adhesion force Fa between the first intermediate transfer member and the intermediate image be 0.5 kg/cm$^2$ or more and 3.0 kg/cm$^2$ or less, and the adhesion force Fb between the second intermediate transfer member and the intermediate image be 1.0 kg/cm$^2$ or more and 5.0 kg/cm$^2$ or less.

In the present invention, the following methods or measures (1) to (6) may be employed as examples of a method for setting the magnitude of the adhesion force with respect to the intermediate image so as to become larger in the order of the first intermediate transfer member, the second intermediate transfer member, and the recording medium. Note that, the methods or measures (1) to (6) may be used alone, or multiple methods or measures may be used in combination.

(1) The surface hardness is set so as to satisfy the relationship of (surface hardness of first intermediate transfer member)>(surface hardness of second intermediate transfer member)<(surface hardness of recording medium).

As the contact area between the second intermediate transfer member and the surface of the recording medium becomes larger, the adhesion force between the intermediate image and the recording medium becomes larger. In addition, in a case where the same magnitude of pressure is applied at the time of transfer, as the surface hardness of the second intermediate transfer member becomes lower, the deformation amount of the intermediate transfer member becomes larger, and hence the contact area between the intermediate transfer member and the recording medium is larger. Thus, in order to increase the adhesion force between the intermediate image and the recording medium, the surface hardness of the second intermediate transfer member is set lower than the surface hardness of the recording medium.

On the other hand, the surface hardness of the first intermediate transfer member is set higher than the surface hardness of the second intermediate transfer member. Thus, in the first transfer step, that is, at the time of transferring the intermediate image from the first intermediate transfer member onto the second intermediate transfer member, the deformation amount of the first intermediate transfer member is smaller, and hence the contact area between the first intermediate transfer member and the intermediate image can be set smaller. As a result, the adhesion force between the first intermediate transfer member and the intermediate image can be set smaller than the adhesion force between the second intermediate transfer member and the intermediate image. Further, in the transfer of the intermediate image from the first intermediate transfer member onto the second intermediate transfer member, when the deformation amounts of both the intermediate transfer members are larger at a nip between the two intermediate transfer members, the intermediate image is distorted. Therefore, the surface hardness of the second intermediate transfer member is set lower and the surface hardness of the first intermediate transfer member is set higher. As a result, the distortion of the intermediate image can be suppressed.

(2) The thickness of the surface layer of the second intermediate transfer member is set larger than the thickness of the surface layer of the first intermediate transfer member.

In a case where the two intermediate transfer members include a common support member and a common surface layer and the total thickness of the two intermediate transfer members is constant, when the thickness of the surface layer of the second intermediate transfer member is set larger than the thickness of the surface layer of the first intermediate transfer member, the adhesion force between the intermediate image and the recording medium can be set larger for the same reason as in the above-mentioned method or measure (1). Specifically, when the thickness of the surface layer of the first intermediate transfer member is set smaller than the thickness of the surface layer of the second intermediate transfer member, the proportion of the support member to the total thickness becomes larger. Thus, the deformation amount of the first intermediate transfer member is smaller, and hence the adhesion force between the first intermediate transfer member and the intermediate image can be set smaller than the adhesion force between the second intermediate transfer member and the intermediate image.

(3) The pressure to be applied in the first transfer step at the time of transferring the intermediate image from the first intermediate transfer member onto the second intermediate transfer member (transfer pressure in the first transfer step) is set smaller than the pressure to be applied in the second transfer step at the time of transferring the intermediate image from the second intermediate transfer member onto the recording medium (transfer pressure in the second transfer step).

When the respective transfer pressures are set so as to satisfy the above-mentioned relationship, for the same reason as in the above-mentioned method or measure (1), the adhesion force between the intermediate image and the recording medium can be set larger and the adhesion force between the first intermediate transfer member and the intermediate image can be set smaller than the adhesion force between the second intermediate transfer member and the intermediate image.

(4) The arithmetic mean roughness Ra of the surface is set so as to satisfy the relationship of ($Ra_1$ of first intermediate transfer member)>($Ra_2$ of second intermediate transfer member)>($Ra_m$ of recording medium).

As the arithmetic mean roughness Ra of the surfaces of the intermediate transfer member and the recording medium becomes smaller, the contact area with the intermediate image becomes larger, and hence the adhesion force of the intermediate image can be set larger. Thus, when the above-mentioned relationship of the arithmetic mean roughness Ra is satisfied, the adhesion force with respect to the intermediate image can be set larger in the order of the first intermediate transfer member, the second intermediate transfer member, and the recording medium. Further, when the arithmetic mean roughness Ra of the surface layer of the first intermediate transfer member is set larger as described above, the retainability of the intermediate image is enhanced, and hence the sliding movement of the intermediate image along the surface can be suppressed. As a result, the intermediate image can be transferred from the first intermediate transfer member onto the second intermediate transfer member at high transfer rate while suppressing the movement of ink at the time of forming the intermediate image on the first intermediate transfer member.

(5) The surface temperature is set so as to satisfy the relationship of (surface temperature of first intermediate transfer member)<(surface temperature of second intermediate transfer member)<(surface temperature of recording medium).

When the surface temperature of the intermediate transfer member and the recording medium is set higher, the temperature of the intermediate image in contact with the intermediate transfer member and the recording medium is raised, and hence the intermediate image is softened. As a result, the adhesion force between the intermediate image and the intermediate transfer member and between the intermediate image and the recording medium is increased. Thus, when the above-mentioned relationship of the surface temperature is satisfied, the adhesion force of the intermediate image can be set larger in the order of the first intermediate transfer member, the second intermediate transfer member, and the recording medium.

(6) The surface layer of the first intermediate transfer member contains a silicone rubber. Further, the surface layer of the second intermediate transfer member is made of a material that is lower in releasability of the intermediate image than the silicone rubber and higher in releasability of the intermediate image than the recording medium.

The silicone rubber is smaller in surface free energy and higher in releasability of the intermediate image. Thus, when the surface layer of the first intermediate transfer member contains the silicone rubber, the adhesion force between the first intermediate transfer member and the intermediate image can be set smaller. Further, when the surface layer of the second intermediate transfer member is made of a material that is lower in releasability of the intermediate image than the silicone rubber, the adhesion force between the second intermediate transfer member and the intermediate image can be set larger than the adhesion force between the first intermediate transfer member and the intermediate image. Still further, when the surface layer of the second intermediate transfer member is made of a material that is higher in releasability of the intermediate image than the recording medium, the adhesion force between the recording medium and the intermediate image can be set larger than the adhesion force between the second intermediate transfer member and the intermediate image. Examples of the material for the surface layer of the second intermediate transfer member include rubbers such as a urethane rubber, a nitrile rubber, and a fluororubber, metals such as aluminum and stainless steel, and resins such as polyethylene and polypropylene.

Further, as described later with reference to FIG. 3, as an embodiment of the present invention, there is a recording apparatus configured to transfer, onto the front surface and the back surface of the recording medium, intermediate images on the first and second intermediate transfer members at the same time, respectively. Also in this recording apparatus, when the above-mentioned methods or measures (1) to (6) are employed, the adhesion force with respect to the intermediate image can be set so as to satisfy the relationship of (first intermediate transfer member)<(second intermediate transfer member)<(recording medium). In other words, when the above-mentioned methods or measures (1) to (6) are employed, the adhesion force between the second intermediate transfer member and the intermediate image is larger than the adhesion force between the first intermediate transfer member and the intermediate image. Further, the adhesion force between the recording medium and the intermediate image is larger than the adhesion force between the second intermediate transfer member and the intermediate image. Therefore, for the same reasons as described above, the intermediate image on the first intermediate transfer member can be transferred onto the second intermediate transfer member efficiently. Still further, the adhesion force between the recording medium and the intermediate image is inevitably larger than the adhesion force between the first intermediate transfer member and the intermediate image. Thus, when the intermediate images on the first and second intermediate transfer members are to be transferred onto the recording medium at the same time, it is conceivable that the intermediate images are released from the first and second intermediate transfer members and transferred onto the recording medium. Note that, the "pressure to be applied at the time of transferring the intermediate image from the second intermediate transfer member onto the recording medium" as described in the above-mentioned method or measure (3) herein refers to a pressure to be applied at the time of transferring, onto the recording medium, the intermediate images on the first and second intermediate transfer members at the same time.

First Embodiment

1. Ink Jet Recording Apparatus

FIG. 1 is a schematic view illustrating an example of an image recording apparatus to be used for an image recording method according to a first embodiment of the present invention. Now, referring to FIG. 1, the image recording apparatus of this embodiment is described in detail.

In FIG. 1, a first transfer drum 1 serves as the first intermediate transfer member including a surface layer having ink releasability. The first transfer drum 1 is supported by a shaft 13, and is configured to be rotationally driven about the shaft 13 in the arrow A direction by a drum drive apparatus (not shown). At positions opposed to the outer circumference of the first transfer drum 1, a treatment liquid application portion 2, an ink application portion 3, an intermediate image processing portion 4, and a cleaning portion 5 are arranged in this order from the upstream side toward the downstream side in the arrow A direction.

A second transfer drum 6 serves as the second intermediate transfer member. Similarly to the first transfer drum 1, the second transfer drum 6 is supported by a shaft 13, and is configured to be rotationally driven about the shaft 13 in the arrow B direction by a drum drive apparatus (not shown). At positions opposed to the outer circumference of the second transfer drum 6, a transfer portion 7, a recording medium separation portion 8, and a cleaning portion 5 are arranged in this order from the upstream side toward the downstream side in the arrow B direction.

The ink jet recording apparatus further includes a paper-feeding conveyance portion 11 configured to convey a recording medium 9 from a recording medium storage portion (paper-feeding cassette) 10 to the transfer portion 7. The ink jet recording apparatus further includes a paper-discharging conveyance and fixing portion 12 configured to fix the intermediate image 23 on the recording medium 9 after an intermediate image 23 is transferred onto the recording medium 9 and to discharge the recording medium 9 to a paper-discharge tray (not shown).

Now, the configuration of each member constituting the image recording apparatus of FIG. 1 is described in more detail.

(1) First Transfer Drum 1 (First Intermediate Transfer Member)

As illustrated in FIG. 1, the first transfer drum 1 serving as the first intermediate transfer member is obtained by laminating a compressive layer 15 made of a sponge rubber on the circumference of a support member 14 made of aluminum and laminating a surface layer 16 made of a silicone rubber on the compressive layer 15.

The material to be used as the support member 14 is not particularly limited to aluminum. The material has only to satisfy characteristics required for, for example, rigidity capable of resisting pressurization at the time of transfer, dimensional accuracy, and the enhancement of the responsiveness of control through the alleviation of the inertia of rotation. For example, a material molded out of a metal such as nickel or iron phosphate, a thermosetting resin excellent in strength such as an acetal, or a ceramic may also be used.

A natural rubber, a chloroprene rubber, an ethylene-propylene rubber, a nitrile rubber, a silicone rubber, or the like may be used for the compressive layer 15 made of a sponge rubber. The rubber for the compressive layer 15 has only to have such a preferred elastic characteristic that when the intermediate image 23 is transferred onto the recording medium 9, a pressure is uniformly applied in the surface of the intermediate image, and to be capable of absorbing the bias of the pressure to be applied. In addition, the layer configuration of the compressive layer 15 may be changed depending on purposes.

In addition, the material for the surface layer 16 having ink releasability is not limited to the silicone rubber. The surface layer 16 has only to have a lower adhesion force with respect to the intermediate image 23 than that of the surface layer of the second transfer drum to be described later, and its layer configuration may be appropriately changed. The surface layer 16 may be, for example, a layer having preferred releasability and preferred elastic characteristics, a layer having a high surface hardness, a layer having a small thickness, or a configuration obtained by combining two or more of the foregoing. Note that, the "releasability" refers to a state in which the intermediate image 23 can be removed without being fixed to the surface of the first transfer drum 1, and the adhesion force between the first transfer drum 1 and the intermediate image can be reduced as the releasability becomes higher. In addition, high releasability is advantageous in terms of a load at the time of cleaning.

In addition, the surface layer 16 preferably has a larger arithmetic mean roughness Ra than that of a surface layer 17 of the second intermediate transfer member in order that the movement of ink at the time of the formation of the intermediate image can be suppressed. Specifically, the arithmetic mean roughness Ra of the surface layer of the first transfer drum 1 is preferably 0.05 μm or more and 5 μm or less. When the arithmetic mean roughness Ra is less than 0.05 μm, the retainability of the intermediate image reduces and hence the movement of the ink at the time of the formation of the intermediate image 23 cannot be suppressed in some cases. On the other hand, when the arithmetic mean roughness Ra exceeds 5 μm, the quality of the intermediate image transferred onto the recording medium 9 may reduce. Further, the retainability of the intermediate image can be enhanced by subjecting the surface layer 16 of the first transfer drum to surface treatment with plasma, UV, or the like to enhance its hydrophilicity.

The surface hardness of the first transfer drum is preferably A40 or more and A95 or less in order that its adhesion force with respect to the intermediate image can be reduced as compared with that of the second transfer drum. In addition, the thickness of the surface layer is preferably 20 μm or more and 200 μm or less.

Note that, the first transfer drum 1 may be provided with a heater or any other temperature adjusting unit. The surface temperature of the first transfer drum 1 is preferably room temperature or more and 120° C. or less because setting the temperature lower than that of the second transfer drum 6 reduces the adhesion force with respect to the intermediate image.

(2) Second Transfer Drum 6 (Second Intermediate Transfer Member)

The second transfer drum 6 serving as the second intermediate transfer member has the same configuration as that of the first transfer drum 1 except the surface layer having ink releasability. The surface layer 17 is formed of a material whose adhesion force with respect to the intermediate image 23 is larger than the adhesion force between the surface layer 16 of the first transfer drum 1 and the intermediate image 23, and is smaller than the adhesion force between the recording medium 9 and the intermediate image 23.

As a material satisfying the properties as described above, for example, when the material for the surface layer 16 of the first transfer drum 1 is a silicone rubber, there may be mentioned a rubber other than the silicone rubber such as a urethane rubber, a nitrile rubber, and a fluororubber as the material for the surface layer 17. In addition, for example, there may be mentioned a metal such as aluminum or stainless steel, and a resin such as polyethylene or polypropylene.

As the contact area between the surface layer 17 and the recording medium 9 becomes larger, the adhesion force between the recording medium 9 and the intermediate image becomes larger than the adhesion force between the surface layer 17 and the intermediate image, and hence the transfer rate of the intermediate image from the second transfer drum 6 onto the recording medium 9 increases. Therefore, for example, a layer having a lower surface hardness, larger thickness, or smaller arithmetic mean roughness Ra than that of the surface layer 16 may be used as the surface layer 17. Specifically, the surface hardness of the second transfer drum is preferably A60 or less and the thickness of its surface layer is preferably 100 μm or more. Thus, the surface layer 17 can easily deform and its contact area with the recording medium 9 becomes larger, and hence the transfer rate of the intermediate image increases.

Note that, the second transfer drum 6 may be provided with a heater or any other temperature adjusting unit. The surface temperature of the second drum is preferably 50° C. or more and 180° C. or less because of the following reasons: when the surface temperature is excessively low, an adhesion force enhancing effect reduces, and when the surface temperature is excessively high, an adverse effect on the recording medium enlarges.

(3) Treatment Liquid Application Portion 2

The treatment liquid application portion 2 in FIG. 1 includes a treatment liquid container 18, a treatment liquid 19, and application rollers 20*a* and 20*b*. The treatment liquid application portion 2 applies the treatment liquid 19 in the treatment liquid container 18 onto the first transfer drum 1. The treatment liquid application portion 2 is arranged on the upstream side of the ink application portion 3 to be described later with respect to the arrow A direction on the first transfer drum 1.

The application roller 20*b* is rotatable in association with the first transfer drum 1 (dependent rotation) or can be controlled to rotate by an independent application roller drive unit (not shown). In addition, the application roller 20*a* is rotatable in association with the application roller 20*b* or can be controlled to rotate by the independent application roller drive unit. When the two application rollers 20*a* and 20*b* rotate as described above, the treatment liquid 19 is applied onto the surface of the first transfer drum 1. The thickness of the treatment liquid 19 to be applied onto the first transfer drum 1, which varies depending on the concentration of the treatment liquid 19, is preferably set to fall within the range of from 0.1 μm or more to 10 μm or less. When the thickness of the applied treatment liquid is less than 0.1 μm, a nonuniform reaction between the treatment liquid and the ink may occur owing to application unevenness. On the other hand, when the thickness exceeds 10 μm, aggregated ink moves on the surface of the treatment liquid and hence beading occurs in some cases. The application rollers 20*a* and 20*b* are preferably made of a material having good wettability with respect to the treatment liquid 19, and a porous material or a material having surface irregularities such as a gravure roll-shaped material may be used.

Further, a unit for applying the treatment liquid 19 is not limited to such roller shape as described above, and a unit capable of applying the treatment liquid 19 onto the first transfer drum 1 may be appropriately used. Specifically, for example, a method involving controlling an application amount with a blade or a method involving applying the liquid with a spray or an ink jet recording head may be employed.

In addition, the treatment liquid application portion 2 is such that control of its separation/contact with respect to the first transfer drum 1 by a separation and contact control apparatus (not shown) can be performed.

(4) Treatment Liquid 19

Now, the treatment liquid 19 to be used in this embodiment is described in detail. The treatment liquid 19 refers to a liquid that chemically reacts with, or physically adsorbs to, a colorant, resin, or the like that may be contained in the ink to cause a reduction in flowability of the entire ink, i.e., a viscosity increase. In addition, the treatment liquid 19 refers to a liquid that aggregates the solid matter of a composition constituting the ink to locally cause the reduction in flowability, i.e., the viscosity increase. Thus, the ink to be applied onto the first transfer drum 1 can be sufficiently retained. As a result, even when ink droplets are brought into contact with each other on the first transfer drum 1, an intermediate image in which the occurrence of beading or bleeding has been suppressed can be formed.

The treatment liquid 19 is appropriately selected depending on the kind of the ink to be used in image recording. For example, it is effective to use a polymer aggregating agent for a dye ink and it is effective to use a polyvalent metal salt for a pigment ink. The polyvalent metal salt is constituted of a polyvalent metal ion that is divalent or more and an anion to be bonded to such polyvalent metal ion. Further, when a metal ion is used as an image fixing component for the dye ink in combination with the polymer aggregating agent, it is desirable that a pigment having the same color as that of a dye be mixed in the ink, or white or transparent fine particles having little influence on its tinge be mixed therein.

Examples of the polymer aggregating agent that may be used for the treatment liquid 19 include a cationic polymer aggregating agent, an anionic polymer aggregating agent, a nonionic polymer aggregating agent, and an amphoteric polymer aggregating agent. In addition, examples of the polyvalent metal ion constituting the polyvalent metal salt include divalent metal ions such as $Ca^{2+}$, $Cu^{2+}$, $Ni^{2+}$, $Mg^{2+}$, and $Zn^{2+}$; and trivalent metal ions such as $Fe^{3+}$ and $Al^{3+}$. Examples of the anion constituting the polyvalent metal salt include $Cl^-$, $NO_3^-$, $SO_4^{2-}$, $I^-$, $Br^-$, $ClO_3^-$, and $RCOO^-$ (R represents an alkyl group). In addition, a material having the reverse property to that of the ink to be used may be used as the treatment liquid. When the ink is, for example, an anionic or alkaline ink, a material having the reverse property to that of the ink, i.e., a cationic or acidic material, may be used as the treatment liquid.

In addition, the treatment liquid 19 is not limited to the above-mentioned materials and may be configured to contain a material except the above-mentioned materials as long as the liquid reduces the flowability of the ink. For example, an organic acid may be used. In addition, a water-soluble organic solvent may be incorporated into the treatment liquid 19 together with a metal salt such as the polyvalent metal salt.

In addition, a water-soluble resin or a water-soluble crosslinking agent may be added to the treatment liquid 19. The material to be used is not limited as long as the material can coexist with the above-mentioned materials. Polyvinyl alcohol, polyvinyl pyrrolidone, or the like is suitably used as the water-soluble resin. Oxazolines or carbodiimides having slow reactivity is suitably used as the water-soluble crosslinking agent in terms of the stability of a reaction liquid. As a result, the transfer efficiency of the intermediate image 23 onto the recording medium 9 or its scratch resistance can be enhanced.

In addition, a surfactant is preferably used in the treatment liquid 19 for the purpose of uniformly applying the treatment liquid 19 onto the first transfer drum 1. Various surfactants such as a water-soluble anionic surfactant, cationic surfactant, nonionic surfactant, and amphoteric surfactant may be used as the surfactant.

In addition to the foregoing, into the treatment liquid 19, an additive such as a viscosity modifier, a pH adjustor, an antiseptic, or an antioxidant may be appropriately added as required. In addition, the treatment liquid 19 to be used in this embodiment, which is more preferably colorless, may have such a pale color that the color tone of each color ink is not changed when the liquid is mixed with the ink on the recording medium 9.

(5) Ink Application Portion 3

In the ink application portion 3, recording heads 21*a* to 21*d* apply ink onto the first transfer drum 1 having the treatment liquid 19 applied thereonto by the treatment liquid application portion 2 as described above, to thereby form the intermediate image 23 through reaction between the treatment liquid 19 and the ink. The recording heads 21*a* to 21*d* include multiple nozzles capable of controlling the ejection of ink at least containing a colorant in response to an image signal to be transmitted from an image supply apparatus (not shown). The ink application portion 3 serves as an image drawing unit.

In FIG. 1, the ink application portion 3 is arranged on the downstream side of the treatment liquid application portion 2 with respect to the arrow A direction on the first transfer drum 1, and includes the recording heads 21*a*, 21*b*, 21*c*, and 21*d*. Note that, the recording heads 21*a*, 21*b*, 21*c*, and 21*d* may hereinafter be referred to collectively as "recording head."

The recording head as used herein includes an array of nozzles including a heating element (ejection heater) serving as an electrothermal conversion element configured to generate, in accordance with energization, thermal energy to be utilized for ejecting ink. Further, the recording head is a line-type recording head including the nozzles arrayed in a direction along the shaft 13 of the first transfer drum 1 (direction perpendicular to the drawing sheet of FIG. 1). The recording head is supplied with ink from an ink tank (not shown). The heating element of the recording head raises the temperature of ink by generating heat in response to an image signal for applying ink, to thereby generate bubbles. Then, the generated bubbles expand to eject ink from the nozzles of the recording head.

Note that, the configuration of the recording head is not limited to that of the line-type recording head. The recording head as used herein may be a so-called serial-type recording head including multiple nozzles arrays provided within a predetermined range in a circumferential direction or an axial direction of the first transfer drum 1. This recording head is configured to scan in the axial direction to sequentially eject ink onto the first transfer drum 1. When this recording head is used, the rotational drive of the first transfer drum 1 is performed intermittently, and the rotational drive for a unit of the range of the circumferential nozzle array of the head or the range of use of the head and the drive stop during the serial scan of the recording head are alternately repeated.

Further, the ink jet recording head is not limited to the recording head using the above-mentioned heating element, and a recording head using any other ejection system, such as a piezoelectric element, may be used instead as long as the ink can be ejected from the nozzles of the recording head. Those recording heads basically have the same configuration as the above-mentioned recording heads 21*a* to 21*d*. As a matter of course, the same modifications as those described above may be employed for the configuration and ejection system.

The recording heads 21*a*, 21*b*, 21*c*, and 21*d* are arranged at a certain interval in the circumferential direction of the first transfer drum 1. In addition, the respective heads are configured to apply inks having different colors to form a color ink image. In the configuration of FIG. 1, the recording heads 21*a*, 21*b*, 21*c*, and 21*d* apply inks having black (K), cyan (C), magenta (M), and yellow (Y) colors, respectively. However, the number of ink jet recording heads included in the ink application portion 3 in this embodiment, the order of the colors of the inks to be ejected onto the first transfer drum 1, and the hues of the inks to be used are not limited to those described above.

(6) Ink

The inks to be used in the ink application portion 3 are not particularly limited, and a general ink may be used. Examples of the colorant include a pigment and a dye. A pigment ink containing a pigment excellent in water resistance and light fastness is particularly preferably used.

In addition, when a liquid containing a metal salt is used as the treatment liquid 19, at least one of the ink and the treatment liquid 19 having added thereto a water-soluble resin, crosslinking agent, or the like for strengthening the internal aggregation force of the intermediate image 23 may be used. The addition of the water-soluble resin can regulate the magnitude of the adhesion force between an intermediate transfer member or the recording medium and the intermediate image 23. In this case, any water-soluble resin may be used but, for example, one having a weight-average molecular weight in the range of from 1,000 or more to 30,000 or less is preferred, and one having a weight-average molecular weight in the range of from 3,000 or more to 15,000 or less is more preferably used. Specific examples thereof include a block copolymer, random copolymer, or graft copolymer formed of at least two or more monomers (at least one thereof is a hydrophilic polymerizable monomer) selected from, for example, styrene, a styrene derivative, vinylnaphthalene, a vinylnaphthalene derivative, an aliphatic alcohol ester of an α,β-ethylenically unsaturated carboxylic acid, acrylic acid, an acrylic acid derivative, maleic acid, a maleic acid derivative, itaconic acid, an itaconic acid derivative, fumaric acid, a fumaric acid derivative, vinyl acetate, vinylpyrrolidone, acrylamide, and derivatives thereof; and salts thereof. Alternatively, a natural resin such as rosin, shellac, or starch may be preferably used.

(7) Intermediate Image Processing Portion 4

Next, in FIG. 1, the intermediate image processing portion 4 includes an IR lamp 22. The intermediate image processing portion 4 removes the solvent component containing water from the intermediate image 23 that is formed by the ink application portion 3. Thus, when the intermediate image is to be transferred from the second transfer drum 6 onto the recording medium 9, the transfer can be performed under a further optimum ink adhesion condition.

The intermediate image processing portion 4 includes the IR lamp 22 so as to remove the solvent in ink, mainly water in ink through evaporation or isolation. Specifically, the intermediate image processing portion 4 is provided for the purpose of adjusting the amount of heat to be generated by the IR lamp 22 in consideration of the difference in permeability of the intermediate image 23 being an ink aggregation image into the recording medium 9, to thereby control transfer characteristics of the intermediate image 23 onto the recording medium 9.

Note that, in this embodiment, the IR lamp 22 is used to accelerate the drying of the intermediate image 23, but an air knife or the like capable of adjusting the air blow temperature and controlling the transfer characteristics of the intermediate image 23 may be used instead.

(8) Paper-Feeding Conveyance Portion 11 and Transfer Portion 7

In FIG. 1, the transfer portion 7 includes a transfer roller 26. Further, the paper-feeding conveyance portion 11 includes conveyance rollers 27*a* and 27*b* and conveyance guides 28*a* and 28*b*. In the transfer portion 7, the recording medium 9, which is conveyed through a guide portion between the conveyance guides 28*a* and 28*b* with the rotation of the conveyance rollers 27*a* and 27*b* of the paper-feeding conveyance portion 11, is brought into press contact with the second transfer drum 6 by the transfer roller 26. Through this control, the intermediate image 23 on the second transfer drum 6 is transferred onto the surface of the recording medium 9.

The transfer roller 26 is arranged so as to cause the recording medium 9 to pass through a nip portion between the transfer roller 26 and the second transfer drum 6, and may be formed of a rubber roller, a metal roller, or the like. When a press control apparatus (not shown) is added to the transfer portion 7, the control for pressing the transfer roller 26 against the second transfer drum 6 and releasing the transfer roller 26 from the second transfer drum 6 can be performed.

In FIG. 1, the conveyance rollers 27*a* and 27*b* rotate in the arrow C direction, and the transfer roller 26 rotates in the arrow D direction. Under a state in which the transfer roller 26 is pressed against the second transfer drum 6, the transfer roller 26 is rotatable in association with the second transfer drum 6 through the recording medium 9. Instead of rotating the transfer roller 26 in association with the second transfer drum 6, the transfer roller 26 may be controlled to rotate by an independent transfer roller drive unit (not shown). Further, in this embodiment, the transfer roller 26 is configured to press the second transfer drum 6 at a linear load of 20 kg/cm$^2$ through the recording medium 9 at the time of transfer. However, the present invention is not limited thereto.

(9) Recording Medium Separation Portion 8

In FIG. 1, the recording medium separation portion 8 includes a separation claw 29. In the recording medium separation portion 8, the separation claw 29 is operated in synchronization with a timing to convey the recording medium 9. When the above-mentioned transfer is ended, the separation claw 29 is driven by a drive apparatus (not shown) so as to separate the recording medium 9 from the second transfer drum 6 and guide the recording medium 9 to the paper-discharging conveyance and fixing portion 12.

(10) Paper-Discharging Conveyance and Fixing Portion 12

In FIG. 1, the paper-discharging conveyance and fixing portion 12 includes conveyance guides 28*c* and 28*d* and conveyance and fixing rollers 30*a* and 30*b*. In the paper-discharging conveyance and fixing portion 12, the recording medium 9 with the intermediate image transferred thereonto, which is guided to a portion between the conveyance guides 28*c* and 28*d*, is heated by the conveyance and fixing rollers 30*a* and 30*b* having infrared heaters provided therein, to thereby fix the transferred image. Further, through the rotation of the rollers 30*a* and 30*b*, the recording medium 9 is conveyed onto the paper-discharge tray (not shown), and the recording of the image onto the recording medium 9 is ended.

Known fixing rollers may be used as the conveyance and fixing rollers 30*a* and 30*b*. When the temperatures of the conveyance and fixing rollers 30*a* and 30*b* are excessively low, the physical properties of the intermediate image hardly change and hence an enhancing effect on the fixability of the intermediate image onto the recording medium 9 may disappear. On the other hand, when the temperatures of the conveyance and fixing rollers 30*a* and 30*b* are excessively high, a harmful effect such as the deformation of the recording medium 9 appears. Accordingly, the temperatures of the conveyance and fixing rollers 30*a* and 30*b* are preferably set to about 30° C. or more and 200° C. or less. In addition, a metal, a silicone rubber, and the like may be used as materials for the conveyance and fixing rollers 30*a* and 30*b*. Note that, a silicone oil or the like may be applied to a roller surface to enhance the releasability of the recording medium 9.

(11) Cleaning Portion 5

In FIG. 1, the cleaning portion 5 includes a cleaning liquid 33, a cleaning liquid retaining member 31, a cleaning liquid supply roller 32*a*, and a cleaning roller 32*b*. The cleaning liquid retaining member 31 stores and retains the cleaning liquid 33. The cleaning roller 32*b* rotates in abutment against each of the first and second transfer drums 1 and 6, and therefore applies the cleaning liquid 33, to thereby remove dust or the like on the first and second transfer drums 1 and 6. The cleaning liquid supply roller 32*a* is arranged between the cleaning liquid retaining member 31 and the cleaning roller 32*b* so as to supply the cleaning liquid 33 from the cleaning liquid retaining member 31 to the cleaning roller 32*b*.

In FIG. 1, the cleaning roller 32*b* may be rotated in association with the first and second transfer drums 1 and 6, or the drive may be controlled by a drive unit (not shown). The cleaning liquid supply roller 32*a* may be rotated in association with the cleaning roller 32*b*, or the drive may be controlled by a drive unit (not shown). In any case, through the rotation of the cleaning liquid supply roller 32*a* and the cleaning roller 32*b*, the cleaning liquid 33 is applied onto each of the first and second transfer drums 1 and 6 through the cleaning liquid supply roller 32*a* and the cleaning roller 32*b*. In this manner, the transfer drums are cleaned.

Note that, the configuration of the cleaning portion 5 is not limited to that illustrated in FIG. 1 as long as the cleaning portion 5 is capable of cleaning the surface of the transfer drum in an appropriate manner. Further, the cleaning liquid 33 is not limited to a particular kind of cleaning liquid, and for example, an aqueous solution containing a surfactant, a water-soluble organic solvent, or the like as used in the above-mentioned treatment liquid may be used suitably.

When a press control apparatus (not shown) is added to the cleaning roller 32*b* similarly to the transfer portion 7, the control for pressing the cleaning roller 32*b* against the transfer drum and releasing the cleaning roller 32*b* from the transfer drum can be performed.

2. Image Recording Method

Figure 2:
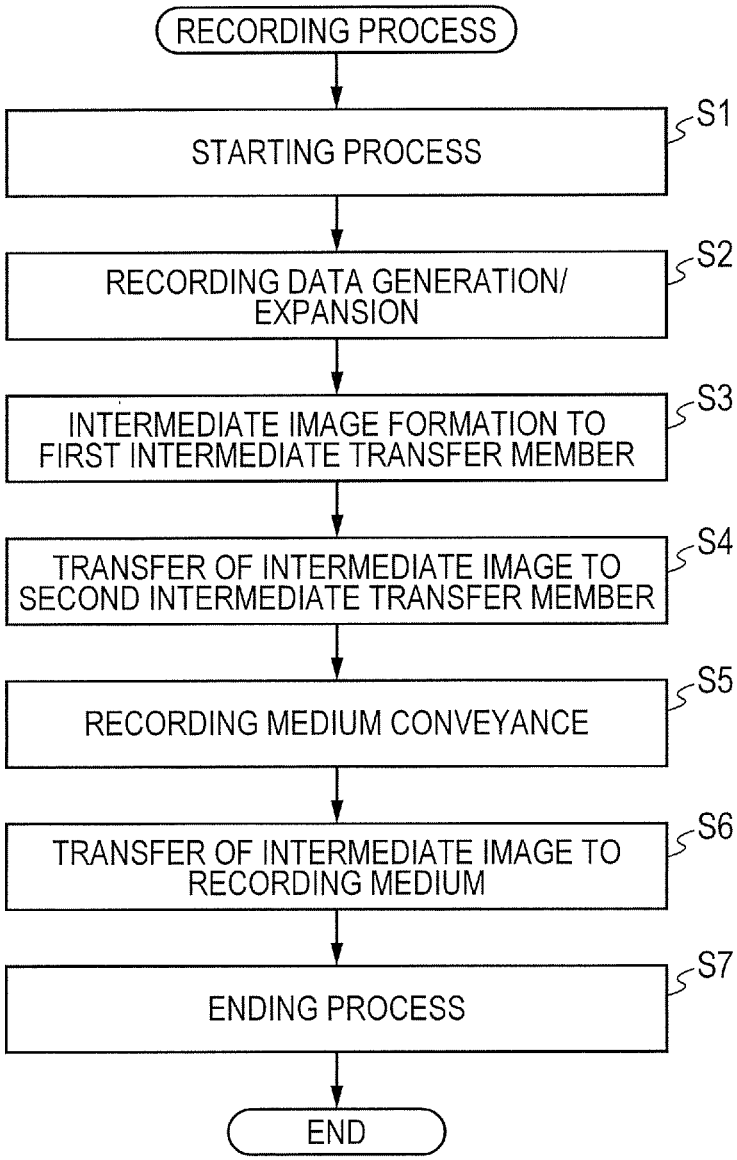
FIG. 2 is a flow chart illustrating a procedure of a recording process of the image recording apparatus illustrated in FIG. 1.

Now, a series of recording operations to be performed by the image recording apparatus of FIG. 1 is described. FIG. 2 is a flow chart illustrating a procedure of a recording process of the image recording apparatus according to the embodiment illustrated in FIG. 1.

Referring to FIG. 2, when power is supplied to the image recording apparatus and the start of recording is instructed, a starting process is first executed (Step S1). In this starting process, the first transfer drum 1 and the second transfer drum 6 are rotationally driven and the heaters arranged inside each transfer drum, the IR lamp 22, and the conveyance and fixing rollers 30*a* and 30*b* are turned ON, respectively. Then, a process of setting and adjusting the temperature of each portion to a predetermined temperature is performed. Further, the position of each portion of the conveyance system for the recording medium 9 may be set as necessary. Still further, when it is desired that the surfaces of the transfer drums be cleaned prior to an ink image formation operation described later, the cleaning rollers 32*b* may be pressed against the first and second transfer drums 1 and 6 to apply and remove the cleaning liquid 33.

Subsequently, an image signal is received from the image supply apparatus such as a computer. Then, in response to the signal, recording data for defining the ejection operation of the ink recording heads 21*a*, 21*b*, 21*c*, and 21*d* is generated and expanded into a memory area (Step S2).

Subsequently, the application roller 20*b* of the treatment liquid application portion 2 is brought into abutment against the first transfer drum 1. Subsequently, through the rotation of the application roller 20*a*, the treatment liquid 19 is applied onto the application roller 20*b* through the application roller 20*a*, and the treatment liquid 19 is uniformly applied onto the first transfer drum 1. When the first transfer drum 1 performs one rotation, the treatment liquid 19 is applied onto the first transfer drum 1, and then the application roller 20*b* is separated from the first transfer drum 1.

Subsequently, based on the above-mentioned expanded recording data, the ink recording heads 21*a*, 21*b*, 21*c*, and 21*d* are driven relative to the first transfer drum 1 that is being rotationally driven, to thereby perform the ejection operation.

Thus, ink is ejected onto the region on the first transfer drum 1 having the treatment liquid 19 thus applied, to thereby form the intermediate image 23 (Step S3). At this time, aggregation and the like occur rapidly through reaction between the ink applied onto the first transfer drum 1 by the ink recording heads 21*a*, 21*b*, 21*c*, and 21*d* and the treatment liquid previously applied by the treatment liquid application portion 2. Therefore, on the first transfer drum 1, the intermediate image 23 is formed from the aggregated ink and the like. In the image recording apparatus of FIG. 1, the intermediate image 23 can efficiently be formed on the first transfer drum 1 as described above. Besides, even when this intermediate image 23 is transferred onto the second transfer drum 6 and the recording medium 9, a high-quality intermediate image can be formed without beading and bleeding. In particular, this effect is more remarkable in a case where high-speed recording is performed or in a case where multiple colors of ink are applied into multiple layers during color ink image formation.

After that, the solvent containing water in the intermediate image 23 is evaporated and dried by the intermediate image processing portion 4, and the intermediate image 23 is set to an ink condition that is further optimum for the transfer to be performed subsequently. Then, the first transfer drum 1 and the second transfer drum 6 are brought into contact with each other, and thus the intermediate image 23 is nipped between both the transfer drums. At this time, the adhesion force between the second transfer drum 6 and the intermediate image 23 is larger than the adhesion force between the first transfer drum 1 and the intermediate image 23, and hence the intermediate image 23 is transferred from the first transfer drum 1 onto the second transfer drum 6 (Step S4). Further, when the pressure to be applied to both the transfer drums is small at this time, the contact area between the intermediate image 23 and the second transfer drum 6 may become insufficient. When the pressure is large, on the other hand, the intermediate image 23 may be distorted. Thus, it is preferred that the pressure be 1.0 kg/cm$^2$ or more and 30.0 kg/cm$^2$ or less.

Meanwhile, the recording medium 9 is sent from the paper-feeding tray 10 to the paper-feeding conveyance portion 11, and the recording medium 9 is conveyed so that the position of the recording medium 9 is aligned with the position of the formed intermediate image 23 (Step S5). Specifically, the recording medium 9 is conveyed toward the transfer portion 7 by the conveyance rollers 27*a* and 27*b* so that the leading edge position of the intermediate image 23, which is formed on the first transfer drum 1 and then transferred onto the second transfer drum 6 as described above, and the recording medium 9 overlap with each other at the nip portion corresponding to a transfer position.

In the transfer portion 7, when a sensor (not shown) detects that the leading edge of the recording medium 9 reaches the nip portion between the second transfer drum 6 and the transfer roller 26, the transfer roller 26 is driven and pressed against the second transfer drum 6 through the recording medium 9. In this case, a predetermined transfer pressure is generated by the press control apparatus, and the intermediate image 23 on the second transfer drum 6 is transferred onto the recording medium 9 (Step S6). In order to increase the contact area between the surface layer 17 of the second transfer drum 6 and the recording medium 9, the pressure to be applied at this time is set larger than the pressure to be applied at the time of transferring the intermediate image 23 from the first transfer drum 1 onto the second transfer drum 6. When the pressure to be applied is small, the contact area between the intermediate image 23 and the recording medium 9 may become insufficient. When the pressure to be applied is large, on the other hand, the intermediate image 23 may be distorted. Thus, it is preferred that the pressure be 5.0 kg/cm$^2$ or more and 50.0 kg/cm$^2$ or less.

At the same time when a sensor (not shown) detects that the leading edge of the recording medium 9 is discharged from the transfer portion 7, the separation claw 29 is driven and inserted between the second transfer drum 6 and the recording medium 9. Thus, the recording medium 9 is separated from the second transfer drum 6. Then, the recording medium 9 separated from the second transfer drum 6 passes along the conveyance guides 28*c* and 28*d*, and is subjected to a fixing process due to heat applied by the conveyance and fixing rollers 30*a* and 30*b*. Then, the recording medium 9 is guided to the paper-discharge tray (not shown).

When the above-mentioned series of formation of the intermediate image 23, conveyance of the recording medium 9, and transfer of the intermediate image 23 is continued and the recording for one recording medium 9 is completed, an ending process is executed (Step S7). Specifically, a process of separating the transfer roller 26 and the separation claw 29 from the second transfer drum is performed. Further, the cleaning rollers 32*b* are brought into abutment against the first transfer drum 1 and the second transfer drum 6, and the surfaces of the respective transfer drums 1 and 6 are cleaned while applying the cleaning liquid 33. When the transfer drums 1 and 6 perform one rotation, a process of separating the cleaning rollers 32*b* from the transfer drums 1 and 6 is executed. When the recording is further continued for a next recording medium 9, the above-mentioned series of operations of formation of the intermediate image 23, conveyance of the recording medium 9, and transfer of the intermediate image 23 is repeated in response to the image signal. When the recording operation is ended and the power is turned OFF, on the other hand, the drive of the respective heaters and the rotational drive of the first transfer drum 1 and the second transfer drum 6 may be turned OFF.

Second Embodiment

1. Image Recording Apparatus

Figure 3:
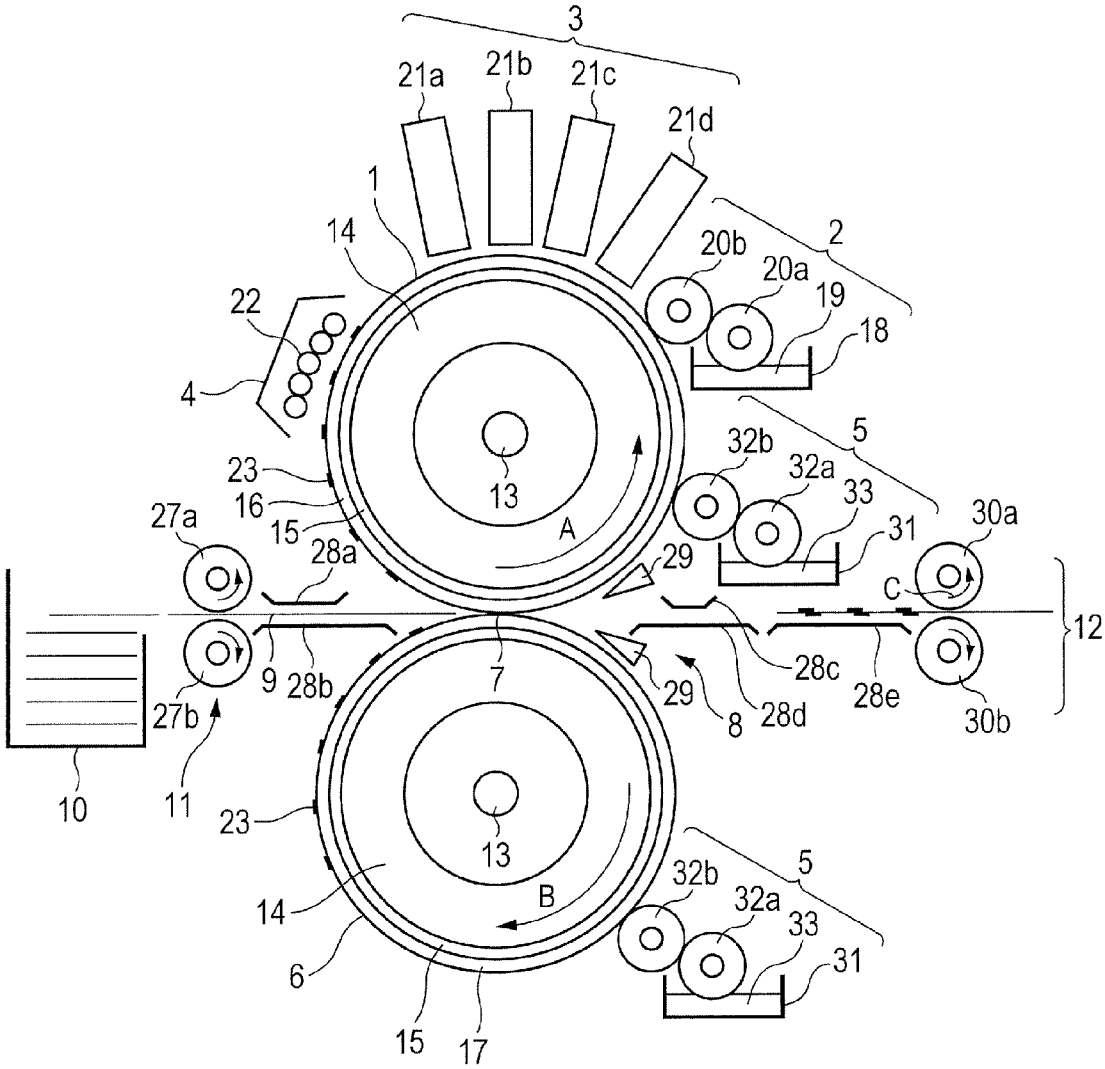
FIG. 3 is a schematic view illustrating an example of an image recording apparatus to be used for an image recording method according to a second embodiment of the present invention.

FIG. 3 is a schematic view illustrating an example of an image recording apparatus to be used for an image recording method according to a second embodiment of the present invention. In FIG. 3, the first transfer drum 1 serves as the first intermediate transfer member including a surface layer having ink releasability. The first transfer drum 1 is supported by the shaft 13, and is configured to be rotationally driven about the shaft 13 in the arrow A direction by the drum drive apparatus (not shown). At positions opposed to the outer circumferential portion of the first transfer drum 1, the treatment liquid application portion 2, the ink application portion 3, the intermediate image processing portion 4, the transfer portion 7, the recording medium separation portion 8, and the cleaning portion 5 are arranged in the order from the upstream side toward the downstream side in the arrow A direction.

The second transfer drum 6 serves as the second intermediate transfer member. Similarly to the first transfer drum 1, the second transfer drum 6 is supported by the shaft 13, and is configured to be rotationally driven about the shaft 13 in the arrow B direction by the drum drive apparatus (not shown). At positions opposed to the outer circumferential portion of the second transfer drum 6, the transfer portion 7, the recording medium separation portion 8, and the cleaning portion 5 are arranged in this order from the upstream side toward the downstream side in the arrow B direction.

The image recording apparatus of this embodiment further includes the paper-feeding conveyance portion 11 configured to convey the recording medium 9 from the recording medium storage portion (paper-feeding cassette) 10 to the transfer portion 7. Further, the image recording apparatus of this embodiment includes the paper-discharging conveyance and fixing portion 12 configured to fix the intermediate image 23 on the recording medium 9 after the intermediate image 23 is transferred onto the recording medium 9 and to discharge the recording medium 9 onto the paper-discharge tray (not shown).

In the image recording apparatus of this embodiment, the first transfer drum 1 and the second transfer drum 6 are held in contact with each other at the transfer portion 7. Thus, the intermediate image 23 can be transferred from the first transfer drum 1 onto the second transfer drum 6. After the intermediate image 23 is transferred from the first transfer drum 1 onto the second transfer drum 6, another intermediate image 23 can be formed on the first transfer drum 1. Then, the recording medium 9 is conveyed to the transfer portion 7, and thus the intermediate image 23 formed on the first transfer drum 1 and the intermediate image 23 transferred from the first transfer drum 1 onto the second transfer drum 6 can be transferred onto the front surface and the back surface of the recording medium 9 at the same time.

Specific configurations of the first transfer drum 1, the second transfer drum 6, the treatment liquid application portion 2, the treatment liquid 19, the ink application portion 3, and the ink to be used in this embodiment may be the same as those of the image recording apparatus of the first embodiment. Further, the intermediate image processing portion 4, the recording medium separation portion 8, the paper-discharging conveyance and fixing portion 12, and the cleaning portion 5 to be used in this embodiment may be the same as those of the image recording apparatus of the first embodiment.

Now, the paper-feeding conveyance portion 11 and the transfer portion 7 are described in detail.

(1) Paper-Feeding Conveyance Portion 11 and Transfer Portion 7

In the transfer portion 7 of FIG. 3, the recording medium 9 is conveyed through the guide portion between the conveyance guides 28*a* and 28*b* with the rotation of the conveyance rollers 27*a* and 27*b* of the paper-feeding conveyance portion 11. Then, the recording medium 9 is caused to pass through the nip under press contact between the first transfer drum 1 and the second transfer drum 6. Through this control, the intermediate image 23 on the first transfer drum 1 and the intermediate image 23 on the second transfer drum 6 are transferred onto the front surface (one surface) of the recording medium 9 and the back surface (other surface) of the recording medium 9 at the same time.

When a press control apparatus (not shown) is added to at least one of the first transfer drum 1 and the second transfer drum 6, the control of pressure application and pressure release with respect to the recording medium 9 passing through the transfer portion 7 can be performed. When the intermediate image 23 is to be transferred from the first transfer drum 1 onto the second transfer drum 6, it is preferred that the transfer pressure be set lower because a sufficient contact area can be secured even at low pressure. When the transfer pressure is set lower, the image distortion can be suppressed. In this embodiment, as for the pressure at the time of transferring the intermediate image 23 from the first transfer drum 1 onto the second transfer drum 6, the first transfer drum 1 and the second transfer drum 6 are pressed at a linear load of kg/cm$^2$. When the intermediate images 23 are to be transferred from the first transfer drum 1 and the second transfer drum 6 onto the recording medium 9 having larger surface roughness, on the other hand, it is preferred that the transfer pressure be set higher so as to bring the intermediate images 23 into contact with the surfaces of the recording medium 9. Further, in this embodiment, as for the pressure at the time of transferring the intermediate images 23 from the first transfer drum 1 and the second transfer drum 6 onto the recording medium 9, the first transfer drum 1 and the second transfer drum 6 are pressed at a linear load of 20 kg/cm$^2$. However, the transfer pressure is not limited to those values.

Further, in the transfer portion 7, the first transfer drum 1 and the second transfer drum 6 may be controlled to be separated from each other and brought into contact with each other by a separation and contact control apparatus (not shown).

2. Image Recording Method

Figure 4:
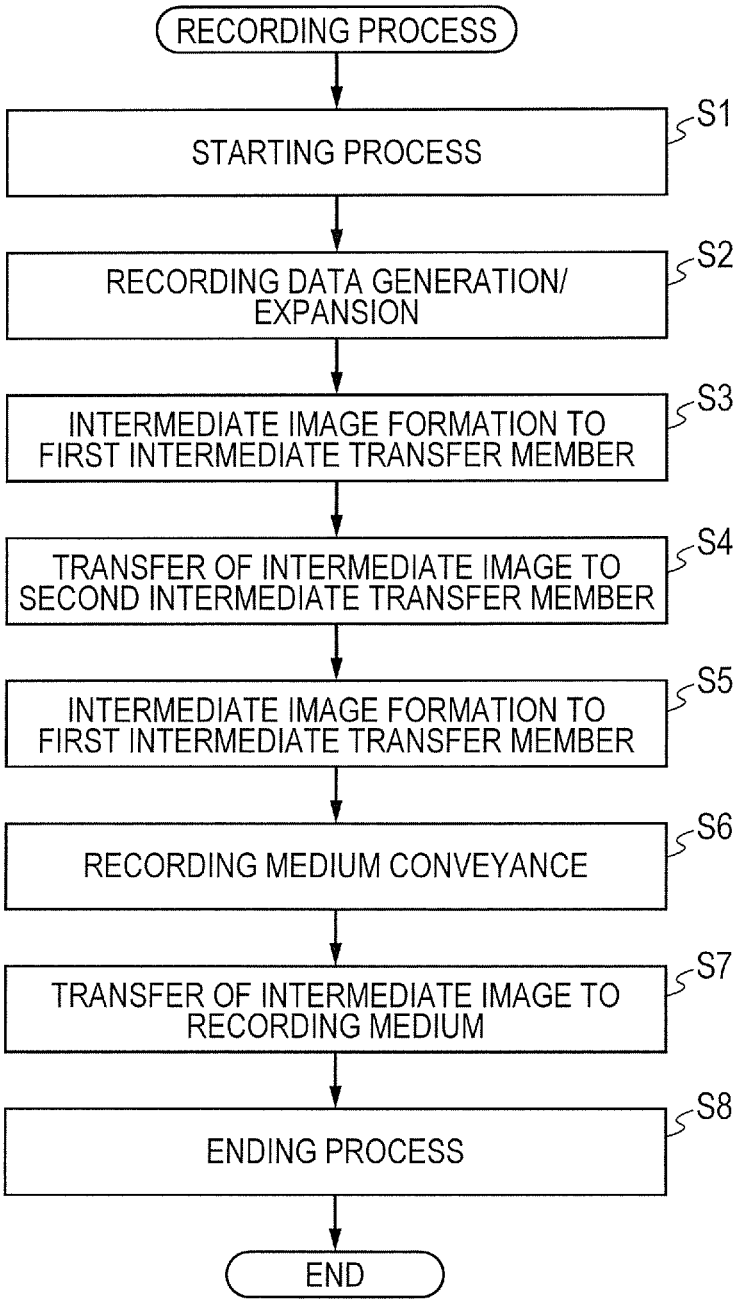
FIG. 4 is a flow chart illustrating a procedure of a recording process of the image recording apparatus illustrated in FIG. 3.

Now, a series of recording operations to be performed by the image recording apparatus of this embodiment is described in detail. FIG. 4 is a flow chart illustrating a procedure of a recording process of the image recording apparatus according to the embodiment illustrated in FIG. 3.

Referring to FIG. 4, a recording starting process is first executed (Step S1). After recording data is generated and expanded into the memory area (Step S2), the intermediate image 23 is formed on the first transfer drum (Step S3). Subsequently, the intermediate image 23 is transferred from the first transfer drum 1 onto the second transfer drum 6 (Step S4). The recording procedure up to the transfer of the intermediate image 23 onto the second transfer drum (Step S4) is the same as that of the image recording method of the first embodiment.

Subsequently, the surface of the first transfer drum 1 is cleaned by the cleaning portion 5, and then the treatment liquid R1 is applied again onto the first transfer drum 1 at a thickness of about 1 μm. After that, in response to binary image signals of the respective colors for the back surface, pigment inks Y1, M1, C1, and K1 are ejected from the recording heads 21*a*, 21*b*, 21*c*, and 21*d*, respectively, to thereby form the intermediate image on the first transfer drum 1. At this time, the intermediate image 23 is formed on the first transfer drum so that the position of the intermediate image 23 is aligned with the position of the intermediate image 23 transferred onto the second transfer drum 6 at the transfer portion 7. After that, the water serving as the main solvent of the intermediate image 23 is evaporated by the IR lamp 22 of the intermediate image processing portion 4, to thereby achieve a condition that is further optimum for the transfer to be performed subsequently (Step S5).

After that, in the transfer portion 7, the recording medium 9 is fed by the conveyance rollers 27*a* and 27*b* (Step S6). Then, the intermediate image 23 on the first transfer drum 1 and the intermediate image 23 on the second transfer drum 6 are transferred onto the front surface (one surface) and the back surface (other surface) of the fed recording medium 9 at the same time, to thereby form a printed product (Step S7). The transfer pressure at the time of producing the printed product is set larger than the pressure to be applied at the time of transferring the intermediate image 23 from the first transfer drum 1 onto the second transfer drum 6. Thus, also at the time of transferring the intermediate image 23 onto the recording medium 9 having larger surface roughness, the contact area between the surface layer 17 of the second transfer drum 6 and the recording medium 9 can be set larger.

At the same time when the sensor (not shown) detects that the leading edge of the recording medium 9 is discharged from the transfer portion 7, the separation claws 29 of the recording medium separation portion 8 are driven. Then, the separation claws 29 are inserted between the first transfer drum 1 and the recording medium 9 and between the second transfer drum 6 and the recording medium 9. Thus, the recording medium 9 is separated from the first transfer drum 1 and the second transfer drum 6. The recording medium 9 separated from the first transfer drum 1 and the second transfer drum 6 passes along the conveyance guides 28*c*, 28*d*, and 28*e*. After that, the recording medium 9 is subjected to a fixing process due to heat applied by the conveyance and fixing rollers 30*a* and 30*b*, and is then guided to the paper-discharge tray (not shown).

When the above-mentioned series of formation of the intermediate image 23, conveyance of the recording medium 9, and transfer of the intermediate image 23 is continued and the recording for one recording medium 9 is completed, an ending process is executed (Step S8). Specifically, a process of separating the separation claws 29 from the first transfer drum 1 and the second transfer drum 6 is performed. Further, the cleaning rollers 32*b* are brought into abutment against the surfaces of the first transfer drum 1 and the second transfer drum 6, and the surfaces of the respective transfer drums 1 and 6 are cleaned while applying the cleaning liquid 33. When the transfer drums 1 and 6 perform one rotation, a process of separating the cleaning rollers 32*b* from the transfer drums 1 and 6 is executed. When the image recording is then further continued for a next recording medium 9, the above-mentioned series of operations of formation of the intermediate image 23, conveyance of the recording medium 9, and transfer of the intermediate image 23 is repeated in response to the image signal. When the recording operation is ended and the power is turned OFF, on the other hand, the drive of the respective heaters and the rotational drive of the first transfer drum 1 and the second transfer drum 6 are turned OFF.

EXAMPLES

Now, the present invention is described in more details by way of Examples and Comparative Examples. This invention is not limited to the following Examples unless going beyond the gist of the present invention. Note that, all the terms "part(s)" and "%" in the following description refer to "part(s) by weight" unless otherwise stated. In addition, the total amount of each of the ink, treatment liquid, and the like used was adjusted to 100 parts with water.

In addition, in the following examples and comparative examples, the adhesion force between each of the first and second intermediate transfer members 1 and 6, and the recording medium 9, and the intermediate image 23 was measured with a probe tackiness tester manufactured by Malcom Co. The measurement was performed under the conditions of a pressurization force of 20 kg/cm$^2$, a pressurization time of 0.1 second, and a drawing speed of 10 mm/sec. In Examples 1 to 6, and Comparative Examples 1 to 3 and 5 to 8, the adhesion force between the recording medium 9 and the intermediate image was 3.5 kg/cm$^2$. An Aurora Coat (trademark) manufactured by Nippon Paper Industries Co., Ltd. was used as the recording medium 9.

The surface hardnesses of the first and second transfer drums were measured with a durometer (manufactured by TECLOCK Corporation).

Pressures at the time of transfer from the first transfer drum 1 onto the second transfer drum 6 and at the time of transfer from the second transfer drum 6 onto the recording medium 9 were measured with a pressure measuring sensor (I-SCAN manufactured by Nitta Corporation). Specifically, the measurement was performed by interposing the sensor between the first and second transfer drums 1 and 6, and between the second transfer drum 6 and the recording medium 9, and applying a pressure.

Example 1

(1) Preparation of Pigment Ink

First, pigment inks of black, cyan, magenta, and yellow colors each containing a pigment and an anionic compound were prepared as described below.

(a) Production of Pigment Ink K1

<Production of Pigment Dispersion Liquid>

The following components were mixed and warmed to 70° C. in a water bath to dissolve the resin component completely.

Styrene-acrylic acid-ethyl acrylate copolymer: 1.5 parts (acid value: 260, weight-average molecular weight: 5,000)

Monoethanolamine: 1.0 part

Diethylene glycol: 5.0 parts

Ion exchange water: balance

To the solution were added 10 parts of carbon black (MCF88, manufactured by Mitsubishi Chemical Corporation) and 1 part of isopropyl alcohol, and the resultant was subjected to premixing for 30 minutes, followed by dispersion treatment under the following conditions.

Disperser: sand grinder (manufactured by AIMEX CO., Ltd.)

Grinding media: zirconium beads, diameter: 1 mm

Filling rate of grinding media:50% (volume ratio)

Grinding time: 3 hours

Further, the dispersion liquid was subjected to centrifugal separation treatment (12,000 rpm, 20 minutes) to remove coarse particles, to thereby obtain a black pigment dispersion liquid.

Preparation of Ink

The pigment dispersion liquid was used. Components having the following composition ratio were mixed to obtain a black pigment ink K1. The surface tension of the ink was 34 mN/m.

Pigment dispersion liquid: 30.0 parts

Glycerin: 10.0 parts

Ethylene glycol: 5.0 parts

2-Pyrrolidone: 5.0 parts

Acetylenol EH (manufactured by Kawaken Fine Chemicals Co., Ltd.): 1.0 part

Ion exchange water: balance (b) Production of Pigment Ink C1

A pigment ink C1 of a cyan color was prepared by the same method as that of the pigment ink K1 except that 10 parts of carbon black (MCF88 manufactured by Mitsubishi Chemical Corporation) used in the preparation of the pigment ink K1 was changed to a Pigment Blue 15.

(c) Production of Pigment Ink M1

A pigment ink M1 of a magenta color was prepared by the same method as that of the pigment ink K1 except that 10 parts of carbon black (MCF88 manufactured by Mitsubishi Chemical Corporation) used in the preparation of the pigment ink K1 was changed to a Pigment Red 7.

(d) Production of Pigment Ink Y1

A pigment ink Y1 of a yellow color was prepared by the same method as that of the pigment ink K1 except that 10 parts of carbon black (MCF88 manufactured by Mitsubishi Chemical Corporation) used in the preparation of the pigment ink K1 was changed to a Pigment Yellow 74.

(2) Production of Treatment Liquid R1

Components having the following composition were mixed and dissolved, and the resultant was subjected to pressure filtration through a membrane filter having a pore size of 0.22 μm (trade name: Fluoropore Filter, manufactured by Sumitomo Electric Industries, Ltd.), to thereby obtain the treatment liquid R1.

Diethylene glycol: 10.0 parts

Calcium chloride dihydrate: 10.0 parts

Acetylenol EH (manufactured by Kawaken Fine Chemicals Co., Ltd.): 0.5 part

Ion exchange water: balance (3) First Transfer Drum

A silicone rubber was used in the surface layer of the first transfer drum. The surface of the transfer drum was modified with an atmospheric-pressure plasma irradiation apparatus (ST-7000 manufactured by KEYENCE CORPORATION) under the following conditions.

Irradiation distance: 5 mm

Plasma mode: High

Processing speed: 20 mm/sec

The adhesion force between the intermediate image and the plasma-treated silicone rubber (surface layer of the first transfer drum) measured with the probe tackiness tester was 1.0 kg/cm$^2$. In addition, the arithmetic mean roughness, surface hardness, and thickness of the surface layer of the first transfer drum were set to 0.5 μm, A90, and 100 μm, respectively in order for the movement of the ink at the time of the formation of the intermediate image to be suppressed.

(4) Second Transfer Drum

A nitrile rubber was used in the surface layer of the second transfer drum. The adhesion force between the intermediate image and the nitrile rubber (surface layer of the second transfer drum) was measured to be 1.8 kg/cm$^2$. The arithmetic mean roughness, surface hardness, and thickness of the surface layer of the second transfer drum were set to 0.1 μm, A40, and 250 μm, respectively.

Therefore, in this example, the adhesion force Fa between the first intermediate transfer member and the intermediate image, the adhesion force Fb between the second intermediate transfer member and the intermediate image, and the adhesion force Fc between the recording medium and the intermediate image satisfy both of the following relationships.

$$Fa<Fb<Fc$$

$$9Fa/4<3Fb/2<Fc \qquad \text{Expression (1)}$$

The surface hardness of the second transfer drum is smaller than the surface hardness of the first transfer drum, and the thickness of the surface layer of the second transfer drum is larger than the thickness of the surface layer of the first transfer drum. Further, the arithmetic mean roughness of the surface of the second transfer drum is smaller than the arithmetic mean roughness of the surface of the first transfer drum.

In this example, the image recording was performed through use of the image recording apparatus of FIG. 1. Note that, each of the recording heads 21*a* to 21*d* for ejecting the inks of the respective colors as used in this example had a recording density of 1,200 dpi, and had a drive frequency of 10 kHz as a drive condition. Further, each of the heads as used in this example had an ejection amount of 4 pl per dot. Note that, the rotational speed of the outer circumference of the transfer drum was set to 100 mm/sec. Then, the image was recorded in the following manner.

First, the treatment liquid R1 was applied onto the first transfer drum 1 at a thickness of about 1 μm, and then the pigment inks Y1, M1, C1, and K1 were sequentially applied by the ink jet recording heads 21*d* to 21*a*, respectively, to thereby obtain the intermediate image 23 on the first transfer drum 1. Subsequently, the water serving as the main solvent was evaporated from the intermediate image 23 on the first transfer drum 1 by the IR lamp 22 in the subsequent step. After that, under a state in which the first transfer drum 1 and the second transfer drum 6 were not heated (remained at room temperature), the intermediate image 23 was transferred from the first transfer drum 1 onto the second transfer drum 6. Note that, the pressure applied at the time of transferring the intermediate image 23 from the first transfer drum 1 onto the second transfer drum 6 was 10 kg/cm$^2$.

After that, the intermediate image 23 on the second transfer drum 6 was transferred onto the recording medium 9 fed by the conveyance rollers 27*a* and 27*b* in the transfer portion 7 under a state in which the second transfer drum 6 was not heated (at room temperature) to produce a printed product. Note that, the pressure applied at the time of the transfer from the second transfer drum 6 onto the recording medium 9 was 20 kg/cm$^2$.

Further, the printed product passed through a gap between the conveyance and fixing rollers 30*a* and 30*b* heated to a temperature of 150° C. to turn into a fixed image.

After that, the transfer rate was calculated by observing the surface of the intermediate transfer member. The transfer rate, which is expressed in percentage, is the proportion of the area of the intermediate image 23 transferred onto the recording medium 9 to the area of the intermediate image 23 formed on the first intermediate transfer member 1.

Example 2

In this example, the treatment liquid R1, and the pigment inks K1, C1, M1, and Y1 described in Example 1 were used, and the image recording apparatus having the configuration of FIG. 1 was used. Note that, a plasma-treated silicone rubber was used in the surface layer of the first transfer drum 1 and a plasma-untreated silicone rubber was used in the surface layer of the second transfer drum 6. The temperature of the surface layer of the second transfer drum 6 was controlled to 60° C. with a heater placed in the drum. The adhesion force between the silicone rubber serving as the surface layer of the second transfer drum 6 and the intermediate image at 60° C. was measured to be 1,500 g/cm$^2$. Note that, the adhesion force between the surface layer of the first transfer drum 1 and the intermediate image 23 was 1.0 kg/cm$^2$ because the transfer conditions of the first transfer drum 1 were set to the same conditions as those of Example 1.

In this example, the intermediate image 23 was formed on the first transfer drum 1 in the same manner as in Example 1, and as a result, a high-quality intermediate image 23 was formed on the first transfer drum 1. Further, the water serving as the main solvent in ink was evaporated by the IR lamp 22. After that, the intermediate image 23 was transferred from the first transfer drum 1 onto the second transfer drum 6. Note that, the pressure applied at the time of transferring the intermediate image 23 from the first transfer drum 1 onto the second transfer drum 6 was 10 kg/cm$^2$.

Then, in the transfer portion 7, the intermediate image 23 on the second transfer drum 6 was transferred onto the recording medium 9 fed by the conveyance rollers 27*a* and 27*b*, to thereby produce a printed product. Note that, the pressure applied at the time of transferring the intermediate image 23 from the second transfer drum 6 onto the recording medium 9 was 20 kg/cm$^2$.

Example 3

In this example, in order to perform duplex printing, the image recording apparatus illustrated in FIG. 3, which was configured to convey the recording medium 9 between the first transfer drum 1 and the second transfer drum 6, was used.

In this example, the intermediate image was formed through use of the treatment liquid R1, the pigment inks K1, C1, M1, and Y1, the first transfer drum 1, and the second transfer drum 6 as described in Example 1. Note that, the recording heads 21*a* to 21*d* for ejecting the inks of the respective colors as used in this example had a recording density of 1,200 dpi, and had a drive frequency of 10 kHz as a drive condition. Further, each of the heads as used in this example had an ejection amount of 4 pl per dot. Note that, the same first and second transfer drums 1 and 6 as in Example 1 were set to the same transfer conditions, and hence the adhesion force between the surface layer of the first transfer drum 1 and the intermediate image 23 was 1.0 kg/cm$^2$. Further, the adhesion force between the surface layer of the second transfer drum 6 and the intermediate image 23 was 1.8 kg/cm$^2$.

First, the treatment liquid R1 was applied onto the first transfer drum 1 at a thickness of about 1 μm, and then the pigment inks Y1, M1, C1, and K1 were ejected from the recording heads 21*a*, 21*b*, 21*c*, and 21*d* in response to binary image signals of the respective colors. Thus, the intermediate image 23 was formed on the first transfer drum 1. Further, the water serving as the main solvent in ink was evaporated from the intermediate image 23 on the transfer drum 1 by the IR lamp 22 in the subsequent step.

After that, under a state in which the first transfer drum 1 and the second transfer drum 6 were not heated (remained at room temperature), the intermediate image 23 on the first transfer drum 1 was transferred onto the second transfer drum at the nip portion between the first transfer drum 1 and the second transfer drum 6. Note that, the pressure applied at the time of transferring the intermediate image 23 was 10 kg/cm$^2$.

Subsequently, the surface of the first transfer drum 1 was cleaned by the cleaning portion 5, and then the treatment liquid R1 was applied again onto the first transfer drum 1 at a thickness of about 1 μm. Subsequently, in response to binary image signals of the respective colors for the back surface, the pigment inks Y1, M1, C1, and K1 were ejected from the recording heads 21*a*, 21*b*, 21*c*, and 21*d* so that the position of the intermediate image 23 was aligned with the position of the intermediate image 23 transferred onto the second transfer drum 6 at the transfer portion 7. Thus, the intermediate image 23 was formed on the first transfer drum 1. Further, the water serving as the main solvent in ink was evaporated by the IR lamp 22.

After that, the recording medium 9 was fed by the conveyance rollers 27*a* and 27*b*. In the transfer portion 7, the intermediate image 23 on the first transfer drum 1 and the intermediate image 23 on the second transfer drum 6 were transferred onto the front surface and the back surface of the fed recording medium 9 at the same time, to thereby produce a printed product. Note that, the pressure applied at the time of transferring the intermediate images 23 was 20 kg/cm$^2$.

Subsequently, the printed product was caused to pass through the conveyance and fixing rollers 30*a* and 30*b* heated at a temperature of 150° C., to thereby form a fixed image.

Example 4

In this example, the treatment liquid R1, and the pigment inks K1, C1, M1, and Y1 described in Example 1 were used, and the image recording apparatus having the configuration of FIG. 1 was used.

A fluororubber was used in the surface layer of the first transfer drum. The adhesion force between the intermediate image and the fluororubber (surface layer of the first transfer drum) measured with the probe tackiness tester manufactured by Malcom Co. in the same manner as in Example 1 was 1.4 kg/cm$^2$. In addition, the arithmetic mean roughness, surface hardness, and thickness of the surface layer were set to 0.5 μm, A90, and 100 μm, respectively.

The nitrile rubber used in the second transfer drum in Example 1 was used in the surface layer of the second transfer drum. The adhesion force between the intermediate image and the nitrile rubber (surface layer of the second transfer drum) was measured to be 1.8 kg/cm$^2$.

Therefore, in this example, the adhesion forces with respect to the intermediate image are arranged in the order of "first transfer drum<second transfer drum<recording medium." However, the condition under which the relationship represented by the expression (1) was not satisfied was established.

In this example, the intermediate image 23 was formed on the first transfer drum 1 in the same manner as in Example 1, and the intermediate image was transferred onto the second transfer drum and the recording medium in the stated order to produce a printed product.

Example 5

Also in this example, the treatment liquid R1, and the pigment inks K1, C1, M1, and Y1 described in Example 1 were used, and the image recording apparatus having the configuration of FIG. 1 was used.

The same surface layer as that of the first transfer drum 1 of Example 1 was used as the surface layer of the first transfer drum 1. Its adhesion force with respect to the intermediate image is 1.0 kg/cm$^2$.

A styrene-butadiene rubber having an arithmetic mean roughness of 0.1 μm, a surface hardness of A40, and a thickness of 250 μm was used in the surface layer of the second transfer drum 6. The adhesion force between the intermediate image and the styrene-butadiene rubber (surface layer of the second transfer drum) was measured to be 2.5 kg/cm$^2$.

Therefore, in this example, the adhesion forces with respect to the intermediate image are arranged in the order "first transfer drum<second transfer drum<recording medium." However, the condition under which the relationship represented by the expression (1) was not satisfied was established.

In this example, the intermediate image 23 was formed on the first transfer drum 1 in the same manner as in Example 1, and the intermediate image was transferred onto the second transfer drum and the recording medium in the stated order to produce a printed product.

Example 6

In this example, the treatment liquid R1, and the pigment inks K1, C1, M1, and Y1 described in Example 1 were used, and the image recording apparatus having the configuration of FIG. 1 was used.

The same nitrile rubber as that of the second transfer drum 6 used in Example 1 was used in the surface layer of the first transfer drum 1. Its adhesion force with respect to the intermediate image is 1.8 kg/cm$^2$.

The same styrene-butadiene rubber as that of the second transfer drum 6 used in Example 5 was used in the surface layer of the second transfer drum 6. Its adhesion force with respect to the intermediate image was measured to be 2.5 kg/cm$^2$.

Therefore, in this example, the adhesion forces with respect to the intermediate image are arranged in the order of "first transfer drum<second transfer drum<recording medium." However, the condition under which the relationship represented by the expression (1) was not satisfied was established.

In this example, the intermediate image 23 was formed on the first transfer drum 1 in the same manner as in Example 1, and the intermediate image was transferred onto the second transfer drum and the recording medium in the stated order to produce a printed product.

Comparative Example 1

In this comparative example, the image recording apparatus having the configuration of FIG. 1 was used, and the treatment liquid R1, and the pigment inks K1, C1, M1, and Y1 described in Example 1 were used. Note that, the surface layers of the first transfer drum 1 and the second transfer drum 6 were exchanged with each other. That is, a nitrile rubber was used in the surface layer of the first transfer drum 1 and a plasma-treated silicone rubber was used in the surface layer of the second transfer drum 6. Therefore, the adhesion force between the intermediate image 23 and the first transfer drum 1 is 1.8 kg/cm$^2$, and the adhesion force between the image and the second transfer drum 6 is 1.0 kg/cm$^2$, and hence the second transfer drum 6 has a smaller adhesion force than that of the first transfer drum 1.

In this comparative example, the intermediate image 23 was formed on the first transfer drum 1 in the same manner as in Example 1, and a high-quality intermediate image 23 was able to be formed on the first transfer drum 1. Further, the water serving as a main solvent in ink was evaporated by the IR lamp 22. After that, the intermediate image 23 on the first transfer drum 1 was brought into contact with the second transfer drum 6. However, the intermediate image 23 was hardly transferred onto the second transfer drum 6, and remained on the first transfer drum 1.

Comparative Example 2

In this comparative example, the image recording apparatus having the configuration of FIG. 1 was used, and the treatment liquid R1, the pigment inks K1, C1, M1, and Y1, and the surface layer of the first transfer drum 1 described in Example 1 were used. Note that, a nitrile rubber having a hardness of A95 and a thickness of 250 μm was used in the surface layer of the second transfer drum 6. That is, in this comparative example, the surface hardness of the second transfer drum 6 is larger than that of the first transfer drum 1. Accordingly, the adhesion force between the intermediate image 23 and the first transfer drum 1 is 1.0 kg/cm$^2$, and the adhesion force between the image and the second transfer drum 6 is 0.86 kg/cm$^2$, and hence the second transfer drum 6 has a smaller adhesion force than that of the first transfer drum 1.

In this comparative example, first, the intermediate image 23 was formed on the first transfer drum in the same manner as in Example 1, and a high-quality intermediate image 23 was formed on the first transfer drum 1. Further, the water serving as a main solvent in ink was evaporated by the IR lamp 22. After that, the intermediate image 23 was transferred from the first transfer drum 1 onto the second transfer drum 6. Further, the intermediate image 23 was transferred from the second transfer drum 6 onto the recording medium 9. However, the intermediate image 23 was hardly transferred from the first transfer drum 1 onto the second transfer drum 6, and remained on the first transfer drum 1.

Comparative Example 3

In this comparative example, the image recording apparatus having the configuration of FIG. 1 was used, and the treatment liquid R1, the pigment inks K1, C1, M1, and Y1, and the first transfer drum 1 described in Example 1 were used. Note that, a nitrile rubber having a hardness of A40 and a thickness of 50 μm was used in the surface layer of the second transfer drum 6. That is, in this comparative example, the thickness of the surface layer of the second transfer drum 6 is smaller than that of the first transfer drum 1. Accordingly, the adhesion force between the intermediate image 23 and the first transfer drum 1 is 1.0 kg/cm$^2$, and the adhesion force between the image and the second transfer drum 6 is 0.91 kg/cm$^2$, and hence the second transfer drum 6 has a smaller adhesion force than that of the first transfer drum 1.

In this comparative example, the intermediate image 23 was formed on the first transfer drum in the same manner as in Example 1, and a high-quality intermediate image 23 was formed on the first transfer drum 1. Further, the water serving as a main solvent in ink was evaporated by the IR lamp 22. The intermediate image 23 was transferred from the first transfer drum 1 onto the second transfer drum 6. Further, the intermediate image 23 was transferred from the second transfer drum 6 onto the recording medium 9. However, the intermediate image 23 was hardly transferred from the first transfer drum 1 onto the second transfer drum 6, and remained on the first transfer drum 1.

Comparative Example 4

In this comparative example, the image recording apparatus having the configuration of FIG. 1 was used, and the pressure applied at the time of transferring the intermediate image 23 from the second transfer drum 6 onto the recording medium 9 was set to 1 kg/cm$^2$. The other conditions were set to the same conditions as in Example 1. Therefore, the adhesion force between the first transfer drum 1 and the intermediate image 23 was 1.0 kg/cm$^2$, and the adhesion force between the second transfer drum 6 and the intermediate image 23 was 1.8 kg/cm$^2$. Thus, the adhesion force was larger in the second transfer drum 6 than in the first transfer drum 1. However, the adhesion force between the recording medium 9 and the intermediate image 23 was smaller than the adhesion force between the second transfer drum 6 and the intermediate image 23.

First, the pigment inks Y1, M1, C1, and K1 were ejected from the recording heads 21*a*, 21*b*, 21*c*, and 21*d*, respectively, in response to binary image signals of the respective colors, to thereby form the intermediate image on the first transfer drum 1. As a result, a high-quality intermediate image 23 was formed on the first transfer drum 1 in the same manner as in Example 1. Further, the water serving as the main solvent in ink was evaporated by the IR lamp 22. The intermediate image 23 was transferred from the first transfer drum 1 onto the second transfer drum 6. Further, the intermediate image 23 was transferred from the second transfer drum 6 onto the recording medium 9. However, the intermediate image 23 was hardly transferred from the second transfer drum 6 onto the recording medium 9, and remained on the second transfer drum 6.

Comparative Example 5

In this comparative example, the image recording apparatus having the configuration of FIG. 1 was used, and the arithmetic mean roughness of the surface layer of the second transfer drum 6 was set to 10 μm. The other conditions were set to the same conditions as in Example 1. Therefore, the adhesion force between the first transfer drum 1 and the intermediate image 23 was 1.0 kg/cm$^2$, and the adhesion force between the second transfer drum 6 and the intermediate image 23 was 0.82 kg/cm$^2$. Thus, the adhesion force was smaller in the second transfer drum 6 than in the first transfer drum 1.

First, the pigment inks Y1, M1, C1, and K1 were ejected from the recording heads 21*a*, 21*b*, 21*c*, and 21*d*, respectively, in response to binary image signals of the respective colors, to thereby form the intermediate image on the first transfer drum 1. As a result, a high-quality intermediate image 23 was formed on the first transfer drum 1 in the same manner as in Example 1. Further, the water serving as the main solvent in ink was evaporated by the IR lamp 22. The intermediate image 23 was transferred from the first transfer drum 1 onto the second transfer drum 6. Further, the intermediate image 23 was transferred from the second transfer drum 6 onto the recording medium 9. However, the intermediate image 23 was partially transferred onto the second transfer drum 6, and mostly remained on the first transfer drum 1.

Comparative Example 6

In this comparative example, the image recording apparatus having the configuration of FIG. 1 was used, and the treatment liquid R1, the pigment inks K1, C1, M1, and Y1, the surface layer of the first transfer drum 1, and the surface layer of the second transfer drum 6 described in Example 1 were used. Note that, the temperature of the surface layer of the first transfer drum 1 was controlled to 60° C. with the heater placed in the drum. In other words, in this comparative example, the temperature of the surface layer of the first transfer drum 1 was set higher than the temperature of the surface layer of the second transfer drum 6. Therefore, the adhesion force between the first transfer drum 1 and the intermediate image 23 was 1.95 kg/cm$^2$, and the adhesion force between the second transfer drum 6 and the intermediate image 23 was 1.8 kg/cm$^2$. Thus, the adhesion force was smaller in the second transfer drum 6 than in the first transfer drum 1.

First, the pigment inks Y1, M1, C1, and K1 were ejected from the recording heads 21*a*, 21*b*, 21*c*, and 21*d*, respectively, in response to binary image signals of the respective colors, to thereby form the intermediate image on the first transfer drum 1. As a result, a high-quality intermediate image 23 was formed on the first transfer drum 1 in the same manner as in Example 1. Further, the water serving as a main solvent in ink was evaporated by the IR lamp 22. After that, the intermediate image 23 on the first transfer drum 1 was brought into contact with the second transfer drum 6. However, in this comparative example, the intermediate image 23 was hardly transferred onto the second transfer drum 6, and remained on the first transfer drum 1.

Comparative Example 7

In this comparative example, the image recording apparatus having the configuration of FIG. 1 was used, and the treatment liquid R1, the pigment inks K1, C1, M1, and Y1, and the surface layer of the second transfer drum 6 described in Example 1 were used. Note that, the intermediate image 23 was formed while the surface layer of the first transfer drum 1 was changed from the silicone rubber to the nitrile rubber used in the second transfer drum 6. Therefore, the adhesion force between the intermediate image 23 and the first transfer drum 1, and the adhesion force between the image and the second transfer drum 6 had the same value, i.e., 1.8 kg/cm$^2$.

First, the pigment inks Y1, M1, C1, and K1 were ejected from the recording heads 21*a*, 21*b*, 21*c*, and 21*d*, respectively, in response to binary image signals of the respective colors, to thereby form the intermediate image on the first transfer drum 1. As a result, a high-quality intermediate image 23 was formed on the first transfer drum 1 in the same manner as in Example 1. Further, the water serving as a main solvent in ink was evaporated by the IR lamp 22. After that, the intermediate image 23 on the first transfer drum 1 was brought into contact with the second transfer drum 6. In this comparative example, however, the adhesion force between the intermediate image 23 and the second transfer drum 6 is the same as the adhesion force between the image and the first transfer drum 1. Accordingly, the so-called tearful parting phenomenon in which about half of the intermediate image 23 was transferred onto the second transfer drum 6 and the other half remained on the first transfer drum 1 occurred.

Comparative Example 8

In this comparative example, the image recording apparatus having the configuration of FIG. 3 was used, and the treatment liquid R1, and the pigment inks K1, C1, M1, and Y1 described in Example 1 were used. Note that, the surface layers of the first transfer drum 1 and the second transfer drum 6 were exchanged with each other. That is, a nitrile rubber was used in the surface layer of the first transfer drum 1 and a plasma-treated silicone rubber was used in the surface layer of the second transfer drum 6. Therefore, the adhesion force between the intermediate image 23 and the first transfer drum 1 is 1.8 kg/cm$^2$, and the adhesion force between the image and the second transfer drum 6 is 1.0 kg/cm$^2$, and hence the second transfer drum 6 has a smaller adhesion force than that of the first transfer drum 1.

First, the pigment inks Y1, M1, C1, and K1 were ejected from the recording heads 21*a*, 21*b*, 21*c*, and 21*d*, respectively, in response to binary image signals of the respective colors, to thereby form the intermediate image on the first transfer drum 1. As a result, a high-quality intermediate image 23 was formed on the first transfer drum 1 in the same manner as in Example 1. Further, the water serving as a main solvent in ink was evaporated by the IR lamp 22. After that, the intermediate image 23 on the first transfer drum 1 was brought into contact with the second transfer drum 6. In this comparative example, the intermediate image 23 was hardly transferred onto the second transfer drum 6, and remained on the first transfer drum 1. Subsequently, the surface of the first transfer drum 1 was cleaned by the cleaning portion 5. After that, the intermediate image 23 was formed again on the first transfer drum 1. Then, the water serving as a main solvent in ink was evaporated by the IR lamp 22.

After that, the recording medium 9 was fed by the conveyance rollers 27*a* and 27*b*. Next, in the transfer portion 7, the intermediate image 23 on the first transfer drum 1 and the intermediate image 23 on the second transfer drum 6 were simultaneously transferred onto the front surface and back surface of the fed recording medium 9, respectively to produce a printed product.

Table 1 below shows the conditions of the first and second transfer drums used in Examples and Comparative Examples, and the results of an evaluation for the transfer rate of the intermediate image 23 onto the recording medium 9. Note that, the "pressure" in the first transfer drum of Table 1 is a pressure at the time of the transfer of the intermediate image from the first transfer drum onto the second transfer drum, and the "pressure" in the second transfer drum is a pressure at the time of the transfer of the intermediate image from the second transfer drum onto the recording medium. In addition, evaluation criteria for the transfer rate in Table 1 are as described below.

AA: The transfer rate was 95% or more.
A: The transfer rate was 80% or more and less than 95%.
B: The transfer rate was 50% or more and less than 80%.
C: The transfer rate was less than 50%.

TABLE 1

| | First transfer drum | | | | | | | Second transfer drum | | | | | | | |
|---|---|---|---|---|---|---|---|---|---|---|---|---|---|---|---|
| | Material | Surface hardness | Thickness (μm) | Pressure (kg/cm$^2$) | Surface roughness (μm) | Temp. (° C.) | Adhesion force with intermediate image (kg/cm$^2$) | Material | Surface hardness | Thickness (μm) | Pressure (kg/cm$^2$) | Surface roughness (μm) | Temp. (° C.) | Adhesion force with intermediate image (kg/cm$^2$) | Transfer rate |
| Example 1 | Silicone rubber | A90 | 100 | 10 | 0.5 | RT | 1.00 | Nitrile rubber | A40 | 250 | 20 | 0.1 | RT | 1.80 | AA |
| Example 2 | Silicone rubber | A90 | 100 | 10 | 0.5 | RT | 1.00 | Silicone rubber (untreated) | A40 | 250 | 20 | 0.1 | 60 | 1.50 | AA |
| Example 3 | Silicone rubber | A90 | 100 | 10 | 0.5 | RT | 1.00 | Nitrile rubber | A40 | 250 | 20 | 0.1 | RT | 1.80 | AA |
| Example 4 | Fluoro rubber | A90 | 100 | 10 | 0.5 | RT | 1.40 | Nitrile rubber | A40 | 250 | 20 | 0.1 | RT | 1.80 | A |
| Example 5 | Silicone rubber | A90 | 100 | 10 | 0.5 | RT | 1.00 | Styrene-butadiene rubber | A40 | 250 | 20 | 0.1 | RT | 2.50 | A |
| Example 6 | Nitrile rubber | A40 | 250 | 20 | 0.1 | RT | 1.80 | Styrene-butadiene rubber | A40 | 250 | 20 | 0.1 | RT | 2.50 | B |
| Comparative Example 1 | Nitrile rubber | A40 | 250 | 10 | 0.1 | RT | 1.80 | Silicone rubber | A90 | 100 | 20 | 0.5 | RT | 1.00 | C |
| Comparative Example 2 | Silicone rubber | A90 | 100 | 10 | 0.5 | RT | 1.00 | Nitrile rubber | A95 | 250 | 20 | 0.1 | RT | 0.86 | C |
| Comparative Example 3 | Silicone rubber | A90 | 100 | 10 | 0.5 | RT | 1.00 | Nitrile rubber | A40 | 50 | 20 | 0.1 | RT | 0.91 | C |
| Comparative Example 4 | Silicone rubber | A90 | 100 | 10 | 0.5 | RT | 1.00 | Nitrile rubber | A40 | 250 | 1 | 0.1 | RT | 1.80 | C |
| Comparative Example 5 | Silicone rubber | A90 | 100 | 10 | 0.5 | RT | 1.00 | Nitrile rubber | A40 | 250 | 20 | 10.0 | RT | 0.82 | C |
| Comparative Example 6 | Silicone rubber | A90 | 100 | 10 | 0.5 | 60 | 1.95 | Nitrile rubber | A40 | 250 | 20 | 0.1 | RT | 1.80 | C |
| Comparative Example 7 | Nitrile rubber | A90 | 100 | 10 | 0.5 | RT | 1.80 | Nitrile rubber | A40 | 250 | 20 | 0.1 | RT | 1.80 | B |
| Comparative Example 8 | Nitrile rubber | A40 | 250 | 10 | 0.1 | RT | 1.80 | Silicone rubber | A90 | 100 | 20 | 0.5 | RT | 1.00 | C |

Note that, the symbol "RT" in the temperature column ("Temp.") in Table 1 represents room temperature. In addition, the transfer rate in Example 3 represents the transfer rate of the intermediate image 23 in the front surface and back surface of the recording medium 9. The transfer rate in Comparative Example 8 represents the transfer rate of the intermediate image 23 in the back surface of the recording medium 9.

It was confirmed that after the production of the printed products of Examples 1 to 6, no ink remained on the first transfer drum and the second transfer drum, or the amount of the ink remaining thereon was small. Further, it was confirmed that even when the respective steps were repeated in Examples 1 to 6, the high-quality image was able to be transferred from the first intermediate transfer member onto the second intermediate transfer member, and from the second intermediate transfer member onto the recording medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-124577, filed Jun. 13, 2013, which is hereby incorporated by reference herein in its entirety.

What is claimed is:

1. An image recording method, comprising:

an intermediate image formation step of forming an intermediate image by applying ink onto a first intermediate transfer member;

a first transfer step of transferring, onto a second intermediate transfer member, the intermediate image that is formed on the first intermediate transfer member; and a second transfer step of transferring, onto a recording medium, the intermediate image that is transferred onto the second intermediate transfer member, wherein the following relationship is satisfied:

$$9Fa/4<3Fb/2<Fc$$

in which Fa represents an adhesion force between the first intermediate transfer member and the intermediate image, Fb represents an adhesion force between the second intermediate transfer member and the intermediate image, and Fc represents an adhesion force between the recording medium and the intermediate image.

2. An image recording method according to claim 1, wherein the adhesion force Fa between the first intermediate transfer member and the intermediate image is 0.5 $kg/cm^2$ or more and 3.0 $kg/cm^2$ or less.

3. An image recording method according to claim 1, wherein the adhesion force Fb between the second intermediate transfer member and the intermediate image is 1.0 $kg/cm^2$ or more and 5.0 $kg/cm^2$ or less.

4. An image recording method according to claim 1, wherein a surface hardness of the first intermediate transfer member is larger than a surface hardness of the second intermediate transfer member, and a surface hardness of the recording medium is larger than the surface hardness of the second intermediate transfer member.

5. An image recording method according to claim 1, wherein a pressure to be applied in the first transfer step at the time of transferring the intermediate image from the first intermediate transfer member onto the second intermediate transfer member is smaller than a pressure to be applied in the second transfer step at the time of transferring the intermediate image from the second intermediate transfer member onto the recording medium.

6. An image recording method according to claim 1, wherein the following relationship is satisfied:

$$Ra_1>Ra_2>Ra_m,$$

in which $Ra_1$ represents an arithmetic mean roughness of a surface of the first intermediate transfer member, $Ra_2$ represents an arithmetic mean roughness of a surface of the second intermediate transfer member, and $Ra_m$ represents an arithmetic mean roughness of a surface of the recording medium.

7. An image recording method according to claim 1, wherein the first intermediate transfer member comprises a support member and a surface layer, and the surface layer contains a silicone rubber.

* * * * *